US011846287B1

(12) United States Patent
Gehret et al.

(10) Patent No.: US 11,846,287 B1
(45) Date of Patent: Dec. 19, 2023

(54) SCROLL COMPRESSOR WITH CENTER HUB

(71) Applicant: Copeland LP, Sidney, OH (US)

(72) Inventors: Natalie M. Gehret, Yorkshire, OH (US); Jason P. Lochner, Union, OH (US); Troy Richard Brostrom, Lima, OH (US); Kent E. Logan, Vandalia, OH (US); Larry Weizman, Clayton, OH (US)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 17/886,047

(22) Filed: Aug. 11, 2022

(51) Int. Cl.

| | |
|---|---|
| ***F04C 18/02*** | (2006.01) |
| ***F04C 29/12*** | (2006.01) |
| ***F04C 28/24*** | (2006.01) |
| ***F04C 28/16*** | (2006.01) |

(52) U.S. Cl.
CPC ..... *F04C 18/0215* (2013.01); *F04C 18/0261* (2013.01); *F04C 28/16* (2013.01); *F04C 28/24* (2013.01); *F04C 29/124* (2013.01); *F04C 29/128* (2013.01)

(58) Field of Classification Search
CPC ..... F04C 2/025; F04C 18/0207–0292; F04C 14/10–16; F04C 28/10–16; F04C 15/06–068; F04C 29/12–128
See application file for complete search history.

(56) References Cited

U.S. PATENT DOCUMENTS

| | | | |
|---|---|---|---|
| 3,303,988 | A | 2/1967 | Weatherhead |
| 4,058,988 | A | 11/1977 | Shaw |
| 4,216,661 | A | 8/1980 | Tojo et al. |
| 4,382,370 | A | 5/1983 | Suefuji et al. |
| 4,383,805 | A | 5/1983 | Teegarden et al. |

(Continued)

FOREIGN PATENT DOCUMENTS

| | | | |
|---|---|---|---|
| AU | 2002301023 | B2 | 6/2005 |
| CN | 1137614 | A | 12/1996 |

(Continued)

OTHER PUBLICATIONS

Office Action dated Mar. 9, 2023, in U.S. Appl. No. 17/835,048.

(Continued)

*Primary Examiner* — Laert Dounis
(74) *Attorney, Agent, or Firm* — Harness, Dickey & Pierce, P.L.C.

(57) ABSTRACT

A compressor may include non-orbiting and orbiting scrolls, a hub plate, and primary and secondary discharge valve assemblies. The non-orbiting scroll includes a first end plate having primary and secondary discharge passages. The hub plate may be mounted to the non-orbiting scroll and may include a main body and a central hub extending axially from the main body. The central hub may include a recess and a hub aperture. The primary discharge valve assembly may include a retainer and a primary valve member. In a closed position, the primary valve member may restrict fluid flow between the discharge chamber and the primary discharge passage. The secondary discharge valve assembly may include a secondary valve member that selectively allows and restricts fluid communication between the secondary discharge passage and the hub aperture of the central hub.

18 Claims, 9 Drawing Sheets

(56) References Cited

U.S. PATENT DOCUMENTS 4,389,171 A 6/1983 Eber et al.
4,466,784 A 8/1984 Hiraga
4,475,360 A 10/1984 Suefuji et al.
4,475,875 A 10/1984 Sugimoto et al.
4,496,296 A 1/1985 Arai et al.
4,497,615 A 2/1985 Griffith
4,508,491 A 4/1985 Schaefer
4,545,742 A 10/1985 Schaefer
4,547,138 A 10/1985 Mabe et al.
4,552,518 A 11/1985 Utter
4,564,339 A 1/1986 Nakamura et al.
4,580,949 A 4/1986 Maruyama et al.
4,609,329 A 9/1986 Pillis et al.
4,650,405 A 3/1987 Iwanami et al.
4,696,630 A 9/1987 Sakata et al.
4,727,725 A 3/1988 Nagata et al.
4,772,188 A 9/1988 Kimura et al.
4,774,816 A 10/1988 Uchikawa et al.
4,818,195 A 4/1989 Murayama et al.
4,824,344 A 4/1989 Kimura et al.
4,838,773 A 6/1989 Noboru
4,842,499 A 6/1989 Nishida et al.
4,846,633 A 7/1989 Suzuki et al.
4,877,382 A 10/1989 Caillat et al.
4,886,425 A 12/1989 Itahana et al.
4,886,433 A 12/1989 Maier
4,898,520 A 2/1990 Nieter et al.
4,927,339 A 5/1990 Riffe et al.
4,936,543 A 6/1990 Kamibayasi
4,940,395 A 7/1990 Yamamoto et al.
4,954,057 A 9/1990 Caillat et al.
4,990,071 A 2/1991 Sugimoto
4,997,349 A 3/1991 Richardson, Jr.
5,024,589 A 6/1991 Jetzer et al.
5,040,952 A 8/1991 Inoue et al.
5,040,958 A 8/1991 Arata et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
5,098,265 A 3/1992 Machida et al.
5,145,346 A 9/1992 Iio et al.
5,152,682 A 10/1992 Morozumi et al.
RE34,148 E 12/1992 Terauchi et al.
5,169,294 A 12/1992 Barito
5,171,141 A 12/1992 Morozumi et al.
5,192,195 A 3/1993 Iio et al.
5,193,987 A 3/1993 Iio et al.
5,199,862 A 4/1993 Kondo et al.
5,213,489 A 5/1993 Kawahara et al.
5,240,389 A 8/1993 Oikawa et al.
5,253,489 A 10/1993 Yoshii
5,304,047 A 4/1994 Shibamoto
5,318,424 A 6/1994 Bush et al.
5,330,463 A 7/1994 Hirano
5,336,068 A 8/1994 Sekiya et al.
5,340,287 A 8/1994 Kawahara et al.
5,356,271 A 10/1994 Miura et al.
5,395,224 A 3/1995 Caillat et al.
5,411,384 A 5/1995 Bass et al.
5,425,626 A 6/1995 Tojo et al.
5,427,512 A 6/1995 Kohsokabe et al.
5,451,146 A 9/1995 Inagaki et al.
5,458,471 A 10/1995 Ni
5,458,472 A 10/1995 Kobayashi et al.
5,482,637 A 1/1996 Rao et al.
5,511,959 A 4/1996 Tojo et al.
5,547,354 A 8/1996 Shimizu et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,591,014 A 1/1997 Wallis et al.
5,607,288 A 3/1997 Wallis et al.
5,611,674 A 3/1997 Bass et al.
5,613,841 A 3/1997 Bass et al.
5,624,247 A 4/1997 Nakamura
5,639,225 A 6/1997 Matsuda et al.
5,640,854 A 6/1997 Fogt et al.
5,649,817 A 7/1997 Yamazaki
5,660,539 A 8/1997 Matsunaga et al.
5,674,058 A 10/1997 Matsuda et al.
5,678,985 A 10/1997 Brooke et al.
5,707,210 A 1/1998 Ramsey et al.
5,722,257 A 3/1998 Ishii et al.
5,741,120 A 4/1998 Bass et al.
5,775,893 A 7/1998 Takao et al.
5,842,843 A 12/1998 Haga
5,855,475 A 1/1999 Fujio et al.
5,885,063 A 3/1999 Makino et al.
5,888,057 A 3/1999 Kitano et al.
5,938,417 A 8/1999 Takao et al.
5,993,171 A 11/1999 Higashiyama
5,993,177 A 11/1999 Terauchi et al.
6,010,312 A 1/2000 Suitou et al.
6,015,277 A 1/2000 Richardson, Jr.
6,030,192 A 2/2000 Hill et al.
6,047,557 A 4/2000 Pham et al.
6,068,459 A 5/2000 Clarke et al.
6,086,335 A 7/2000 Bass et al.
6,093,005 A 7/2000 Nakamura
6,095,765 A 8/2000 Khalifa
6,102,671 A 8/2000 Yamamoto et al.
6,120,255 A 9/2000 Schumann et al.
6,123,517 A 9/2000 Brooke et al.
6,123,528 A 9/2000 Sun et al.
6,132,179 A 10/2000 Higashiyama
6,139,287 A 10/2000 Kuroiwa et al.
6,139,291 A 10/2000 Perevozchikov
6,149,401 A 11/2000 Iwanami et al.
6,152,714 A 11/2000 Mitsuya et al.
6,164,940 A 12/2000 Terauchi et al.
6,174,149 B1 1/2001 Bush
6,176,686 B1 1/2001 Wallis et al.
6,179,589 B1 1/2001 Bass et al.
6,182,646 B1 2/2001 Silberstein et al.
6,202,438 B1 3/2001 Barito
6,210,120 B1 4/2001 Hugenroth et al.
6,213,731 B1 4/2001 Doepker et al.
6,231,316 B1 5/2001 Wakisaka et al.
6,257,840 B1 7/2001 Ignatiev et al.
6,264,444 B1 7/2001 Nakane et al.
6,267,565 B1 7/2001 Seibel et al.
6,273,691 B1 8/2001 Morimoto et al.
6,280,154 B1 8/2001 Clendenin et al.
6,290,477 B1 9/2001 Gigon
6,293,767 B1 9/2001 Bass
6,293,776 B1 9/2001 Hahn et al.
6,309,194 B1 10/2001 Fraser et al.
6,322,340 B1 11/2001 Itoh et al.
6,338,912 B1 1/2002 Ban et al.
6,350,111 B1 2/2002 Perevozchikov et al.
6,361,890 B1 3/2002 Ban et al.
6,379,123 B1 4/2002 Makino et al.
6,389,837 B1 5/2002 Morozumi
6,412,293 B1 7/2002 Pham et al.
6,413,058 B1 7/2002 Williams et al.
6,419,457 B1 7/2002 Seibel et al.
6,428,286 B1 8/2002 Shimizu et al.
6,454,551 B2 9/2002 Kuroki et al.
6,457,948 B1 10/2002 Pham
6,464,481 B2 10/2002 Tsubai et al.
6,478,550 B2 11/2002 Matsuba et al.
6,506,036 B2 1/2003 Tsubai et al.
6,514,060 B1 2/2003 Ishiguro et al.
6,537,043 B1 3/2003 Chen
6,544,016 B2 4/2003 Gennami et al.
6,558,143 B2 5/2003 Nakajima et al.
6,589,035 B1 7/2003 Tsubono et al.
6,619,062 B1 9/2003 Shibamoto et al.
6,679,683 B2 1/2004 Seibel et al.
6,705,848 B2 3/2004 Scancarello

(56) References Cited

U.S. PATENT DOCUMENTS 6,715,999 B2 4/2004 Ancel et al.
6,746,223 B2 6/2004 Manole
6,769,881 B2 8/2004 Lee
6,769,888 B2 8/2004 Tsubono et al.
6,773,242 B1 8/2004 Perevozchikov
6,817,847 B2 11/2004 Agner
6,821,092 B1 11/2004 Gehret et al.
6,863,510 B2 3/2005 Cho
6,881,046 B2 4/2005 Shibamoto et al.
6,884,042 B2 4/2005 Zili et al.
6,887,051 B2 5/2005 Sakuda et al.
6,893,229 B2 5/2005 Choi et al.
6,896,493 B2 5/2005 Chang et al.
6,896,498 B1 5/2005 Patel
6,913,448 B2 7/2005 Liang et al.
6,984,114 B2 1/2006 Zili et al.
7,018,180 B2 3/2006 Koo
7,029,251 B2 4/2006 Chang et al.
7,118,358 B2 10/2006 Tsubono et al.
7,137,796 B2 11/2006 Tsubono et al.
7,160,088 B2 1/2007 Peyton
7,172,395 B2 2/2007 Shibamoto et al.
7,197,890 B2 4/2007 Taras et al.
7,207,787 B2 4/2007 Liang et al.
7,228,710 B2 6/2007 Lifson
7,229,261 B2 6/2007 Morimoto et al.
7,255,542 B2 8/2007 Lifson et al.
7,261,527 B2 8/2007 Alexander et al.
7,311,740 B2 12/2007 Williams et al.
7,344,365 B2 3/2008 Takeuchi et al.
RE40,257 E 4/2008 Doepker et al.
7,354,259 B2 4/2008 Tsubono et al.
7,364,416 B2 4/2008 Liang et al.
7,371,057 B2 5/2008 Shin et al.
7,371,059 B2 5/2008 Ignatiev et al.
RE40,399 E 6/2008 Hugenroth et al.
RE40,400 E 6/2008 Bass et al.
7,393,190 B2 7/2008 Lee et al.
7,404,706 B2 7/2008 Ishikawa et al.
RE40,554 E 10/2008 Bass et al.
7,510,382 B2 3/2009 Jeong
7,547,202 B2 6/2009 Knapke
7,641,455 B2 1/2010 Fujiwara et al.
7,674,098 B2 3/2010 Lifson
7,695,257 B2 4/2010 Joo et al.
7,717,687 B2 5/2010 Reinhart
7,771,178 B2 8/2010 Perevozchikov et al.
7,802,972 B2 9/2010 Shimizu et al.
7,815,423 B2 10/2010 Guo et al.
7,891,961 B2 2/2011 Shimizu et al.
7,896,629 B2 3/2011 Ignatiev et al.
RE42,371 E 5/2011 Peyton
7,956,501 B2 6/2011 Jun et al.
7,967,582 B2 6/2011 Akei et al.
7,967,583 B2 6/2011 Stover et al.
7,972,125 B2 7/2011 Stover et al.
7,976,289 B2 7/2011 Masao
7,976,295 B2 7/2011 Stover et al.
7,988,433 B2 8/2011 Akei et al.
7,988,434 B2 8/2011 Stover et al.
8,025,492 B2 9/2011 Seibel et al.
8,303,278 B2 11/2012 Roof et al.
8,303,279 B2 11/2012 Hahn
8,308,448 B2 11/2012 Fields et al.
8,313,318 B2 11/2012 Stover et al.
8,328,531 B2 12/2012 Milliff et al.
8,393,882 B2 3/2013 Ignatiev et al.
8,506,271 B2 8/2013 Seibel et al.
8,517,703 B2 8/2013 Doepker
8,585,382 B2 11/2013 Akei et al.
8,616,014 B2 12/2013 Stover et al.
8,672,646 B2 3/2014 Ishizono et al.
8,757,988 B2 6/2014 Fukudome et al.
8,790,098 B2 7/2014 Stover et al.
8,840,384 B2 9/2014 Patel et al.
8,857,200 B2 10/2014 Stover et al.
8,932,036 B2 1/2015 Monnier et al.
9,080,446 B2 7/2015 Heusler et al.
9,127,677 B2 9/2015 Doepker
9,145,891 B2 9/2015 Kim et al.
9,169,839 B2 10/2015 Ishizono et al.
9,217,433 B2 12/2015 Park et al.
9,228,587 B2 1/2016 Lee et al.
9,249,802 B2 2/2016 Doepker et al.
9,297,383 B2 3/2016 Jin et al.
9,303,642 B2 4/2016 Akei et al.
9,435,340 B2 9/2016 Doepker et al.
9,494,157 B2 11/2016 Doepker
9,541,084 B2 1/2017 Ignatiev et al.
9,556,862 B2 1/2017 Yoshihiro et al.
9,605,677 B2 3/2017 Heidecker et al.
9,624,928 B2 4/2017 Yamazaki et al.
9,638,191 B2 5/2017 Stover
9,651,043 B2 5/2017 Stover et al.
9,777,730 B2 10/2017 Doepker et al.
9,777,863 B2 10/2017 Higashidozono et al.
9,790,940 B2 10/2017 Doepker et al.
9,850,903 B2 12/2017 Perevozchikov
9,869,315 B2 1/2018 Jang et al.
9,879,674 B2 1/2018 Akei et al.
9,885,347 B2 2/2018 Lachey et al.
9,920,759 B2 * 3/2018 Sung ..... F04C 23/008
9,989,057 B2 6/2018 Lochner et al.
10,066,622 B2 9/2018 Pax et al.
10,087,936 B2 10/2018 Pax et al.
10,094,380 B2 10/2018 Doepker et al.
10,428,818 B2 10/2019 Jin et al.
10,563,891 B2 2/2020 Smerud et al.
10,724,523 B2 7/2020 Wu et al.
10,815,999 B2 10/2020 Jeong
10,907,633 B2 2/2021 Doepker et al.
10,954,940 B2 3/2021 Akei et al.
10,974,317 B2 4/2021 Ruxanda et al.
2001/0010800 A1 8/2001 Kohsokabe et al.
2002/0039540 A1 4/2002 Kuroki et al.
2002/0057975 A1 5/2002 Nakajima et al.
2003/0044296 A1 3/2003 Chen
2003/0044297 A1 3/2003 Gennami et al.
2003/0186060 A1 10/2003 Rao
2003/0228235 A1 12/2003 Sowa et al.
2004/0126259 A1 7/2004 Choi et al.
2004/0136854 A1 7/2004 Kimura et al.
2004/0146419 A1 7/2004 Kawaguchi et al.
2004/0170509 A1 9/2004 Wehrenberg et al.
2004/0184932 A1 9/2004 Lifson
2004/0197204 A1 10/2004 Yamanouchi et al.
2005/0019177 A1 1/2005 Shin et al.
2005/0019178 A1 1/2005 Shin et al.
2005/0053507 A1 3/2005 Takeuchi et al.
2005/0069444 A1 3/2005 Peyton
2005/0140232 A1 6/2005 Lee et al.
2005/0201883 A1 9/2005 Clendenin et al.
2005/0214148 A1 9/2005 Ogawa et al.
2006/0099098 A1 5/2006 Lee et al.
2006/0138879 A1 6/2006 Kusase et al.
2006/0198748 A1 9/2006 Grassbaugh et al.
2006/0228243 A1 10/2006 Sun et al.
2006/0233657 A1 * 10/2006 Bonear ..... F04C 28/28
418/55.6
2007/0003666 A1 1/2007 Gutknecht et al.
2007/0036661 A1 2/2007 Stover
2007/0110604 A1 5/2007 Peyton
2007/0130973 A1 6/2007 Lifson et al.
2008/0115357 A1 5/2008 Li et al.
2008/0138227 A1 6/2008 Knapke
2008/0159892 A1 7/2008 Huang et al.
2008/0159893 A1 7/2008 Caillat
2008/0196445 A1 8/2008 Lifson et al.
2008/0223057 A1 9/2008 Lifson et al.
2008/0226483 A1 9/2008 Iwanami et al.
2008/0286118 A1 11/2008 Gu et al.
2008/0305270 A1 12/2008 Uhlianuk et al.
2009/0013701 A1 1/2009 Lifson et al.
2009/0035167 A1 2/2009 Sun

(56) References Cited

U.S. PATENT DOCUMENTS

2009/0068048 A1 3/2009 Stover et al.
2009/0071183 A1 3/2009 Stover et al.
2009/0185935 A1 7/2009 Seibel et al.
2009/0191080 A1 7/2009 Ignatiev et al.
2009/0297377 A1 12/2009 Stover et al.
2009/0297378 A1 12/2009 Stover et al.
2009/0297379 A1 12/2009 Stover et al.
2009/0297380 A1 12/2009 Stover et al.
2010/0111741 A1 5/2010 Chikano et al.
2010/0135836 A1 6/2010 Stover et al.
2010/0158731 A1 6/2010 Akei et al.
2010/0209278 A1 8/2010 Tarao et al.
2010/0212311 A1 8/2010 McQuary et al.
2010/0212352 A1 8/2010 Kim et al.
2010/0254841 A1 10/2010 Akei et al.
2010/0300659 A1 12/2010 Stover et al.
2010/0303659 A1 12/2010 Stover et al.
2011/0052437 A1 3/2011 Iitsuka et al.
2011/0135509 A1 6/2011 Fields et al.
2011/0206548 A1 8/2011 Doepker
2011/0243777 A1 10/2011 Ito et al.
2011/0250085 A1 10/2011 Stover et al.
2011/0293456 A1 12/2011 Seibel et al.
2012/0009076 A1 1/2012 Kim et al.
2012/0107163 A1 5/2012 Monnier et al.
2012/0183422 A1 7/2012 Bahmata
2012/0195781 A1 8/2012 Stover et al.
2013/0078128 A1 3/2013 Akei
2013/0089448 A1 4/2013 Ginies et al.
2013/0094987 A1 4/2013 Yamashita et al.
2013/0121857 A1 5/2013 Liang et al.
2013/0177465 A1 7/2013 Clendenin et al.
2013/0195707 A1 8/2013 Kozuma et al.
2013/0302198 A1 11/2013 Ginies et al.
2013/0309118 A1 11/2013 Ginies et al.
2013/0315768 A1 11/2013 Le Coat et al.
2014/0023540 A1 1/2014 Heidecker et al.
2014/0024563 A1 1/2014 Heidecker et al.
2014/0037486 A1 2/2014 Stover et al.
2014/0134030 A1 5/2014 Stover et al.
2014/0134031 A1* 5/2014 Doepker ..... F04C 18/0215 418/55.1
2014/0147294 A1 5/2014 Fargo et al.
2014/0154121 A1 6/2014 Doepker
2014/0154124 A1 6/2014 Doepker et al.
2014/0219846 A1 8/2014 Ignatiev et al.
2015/0037184 A1 2/2015 Rood et al.
2015/0086404 A1 3/2015 Kiem et al.
2015/0192121 A1 7/2015 Sung et al.
2015/0275898 A1* 10/2015 Ahire ..... F04C 23/008 418/55.2
2015/0300353 A1* 10/2015 Utpat ..... F04C 29/12 138/26
2015/0330386 A1 11/2015 Doepker
2015/0345493 A1* 12/2015 Lochner ..... F04C 29/128 418/55.5
2015/0354719 A1 12/2015 van Beek et al.
2016/0025093 A1 1/2016 Doepker
2016/0025094 A1 1/2016 Ignatiev et al.
2016/0032924 A1 2/2016 Stover
2016/0047380 A1 2/2016 Kim et al.
2016/0053755 A1 2/2016 Taguchi
2016/0053759 A1 2/2016 Choi et al.
2016/0076543 A1 3/2016 Akei et al.
2016/0115954 A1 4/2016 Doepker et al.
2016/0138879 A1 5/2016 Matsukado et al.
2016/0201673 A1 7/2016 Perevozchikov et al.
2016/0208803 A1 7/2016 Uekawa et al.
2017/0002817 A1 1/2017 Stover
2017/0002818 A1 1/2017 Stover
2017/0030354 A1 2/2017 Stover
2017/0241417 A1 8/2017 Jin et al.
2017/0268510 A1 9/2017 Stover et al.
2017/0306960 A1 10/2017 Pax et al.
2017/0314558 A1 11/2017 Pax et al.
2017/0342978 A1 11/2017 Doepker
2017/0342983 A1 11/2017 Jin et al.
2017/0342984 A1 11/2017 Jin et al.
2018/0023570 A1 1/2018 Huang et al.
2018/0038369 A1 2/2018 Doepker et al.
2018/0038370 A1 2/2018 Doepker et al.
2018/0066656 A1 3/2018 Perevozchikov et al.
2018/0066657 A1 3/2018 Perevozchikov et al.
2018/0135625 A1 5/2018 Naganuma et al.
2018/0149155 A1 5/2018 Akei et al.
2018/0216618 A1 8/2018 Jeong
2018/0223823 A1 8/2018 Ignatiev et al.
2019/0040861 A1 2/2019 Doepker et al.
2019/0101120 A1 4/2019 Perevozchikov et al.
2019/0186491 A1 6/2019 Perevozchikov et al.
2019/0203709 A1 7/2019 Her et al.
2019/0353164 A1 11/2019 Berning et al.
2020/0057458 A1 2/2020 Taguchi
2020/0291943 A1 9/2020 McBean et al.

FOREIGN PATENT DOCUMENTS

CN 1158944 A 9/1997
CN 1158945 A 9/1997
CN 1177681 A 4/1998
CN 1177683 A 4/1998
CN 1259625 A 7/2000
CN 1286358 A 3/2001
CN 1289011 A 3/2001
CN 1339087 A 3/2002
CN 1349053 A 5/2002
CN 1382912 A 12/2002
CN 1407233 A 4/2003
CN 1407234 A 4/2003
CN 1517553 A 8/2004
CN 1601106 A 3/2005
CN 1680720 A 10/2005
CN 1702328 A 11/2005
CN 2747381 Y 12/2005
CN 1757925 A 4/2006
CN 1828022 A 9/2006
CN 1854525 A 11/2006
CN 1963214 A 5/2007
CN 1995756 A 7/2007
CN 101358592 A 2/2009
CN 101684785 A 3/2010
CN 101761479 A 6/2010
CN 101806302 A 8/2010
CN 101910637 A 12/2010
CN 102076963 A 5/2011
CN 102089525 A 6/2011
CN 102272454 A 12/2011
CN 102400915 A 4/2012
CN 102422024 A 4/2012
CN 102449314 A 5/2012
CN 102705234 A 10/2012
CN 102762866 A 10/2012
CN 202926640 U 5/2013
CN 103502644 A 1/2014
CN 103671125 A 3/2014
CN 203962320 U 11/2014
CN 204041454 U 12/2014
CN 104838143 A 8/2015
CN 105317678 A 2/2016
CN 205533207 U 8/2016
CN 205823629 U 12/2016
CN 205876712 U 1/2017
CN 205876713 U 1/2017
CN 205895597 U 1/2017
CN 106662104 A 5/2017
CN 106979153 A 7/2017
CN 207513832 U 6/2018
CN 209621603 U 11/2019
CN 209654225 U 11/2019
CN 209781195 U 12/2019
DE 3917656 C2 11/1995
DE 102011001394 A1 9/2012
EP 0256445 A2 2/1988
EP 0747598 A2 12/1996

(56) References Cited

FOREIGN PATENT DOCUMENTS

| | | | |
|---|---|---|---|
| EP | 0822335 | A2 | 2/1998 |
| EP | 1067289 | A2 | 1/2001 |
| EP | 1087142 | A2 | 3/2001 |
| EP | 1182353 | A1 | 2/2002 |
| EP | 1241417 | A1 | 9/2002 |
| EP | 1371851 | A2 | 12/2003 |
| EP | 1382854 | A2 | 1/2004 |
| EP | 2151577 | A1 | 2/2010 |
| EP | 1927755 | A3 | 11/2013 |
| FR | 2764347 | A1 | 12/1998 |
| GB | 2107829 | A | 5/1983 |
| JP | S58214689 | A | 12/1983 |
| JP | S60259794 | A | 12/1985 |
| JP | S62220789 | A | 9/1987 |
| JP | S6385277 | A | 4/1988 |
| JP | S63205482 | A | 8/1988 |
| JP | H01178789 | A | 7/1989 |
| JP | H0281982 | A | 3/1990 |
| JP | H02153282 | A | 6/1990 |
| JP | H03081588 | A | 4/1991 |
| JP | H03233101 | A | 10/1991 |
| JP | H04121478 | A | 4/1992 |
| JP | H04272490 | A | 9/1992 |
| JP | H0610601 | A | 1/1994 |
| JP | H0726618 | B2 | 3/1995 |
| JP | H07293456 | A | 11/1995 |
| JP | H08247053 | A | 9/1996 |
| JP | H08320079 | A | 12/1996 |
| JP | H08334094 | A | 12/1996 |
| JP | H09177689 | A | 7/1997 |
| JP | H11107950 | A | 4/1999 |
| JP | H11166490 | A | 6/1999 |
| JP | 2951752 | B2 | 9/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 3141949 | B2 | 3/2001 |
| JP | 2002202074 | A | 7/2002 |
| JP | 2003074481 | A | 3/2003 |
| JP | 2003074482 | A | 3/2003 |
| JP | 2003106258 | A | 4/2003 |
| JP | 2003214365 | A | 7/2003 |
| JP | 2003227479 | A | 8/2003 |
| JP | 2004239070 | A | 8/2004 |
| JP | 2005264827 | A | 9/2005 |
| JP | 2006083754 | A | 3/2006 |
| JP | 2006183474 | A | 7/2006 |
| JP | 2007154761 | A | 6/2007 |
| JP | 2007228683 | A | 9/2007 |
| JP | 2008248775 | A | 10/2008 |
| JP | 2008267707 | A | 11/2008 |
| JP | 2013104305 | A | 5/2013 |
| JP | 2013167215 | A | 8/2013 |
| KR | 870000015 | B1 | 1/1987 |
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 101009266 | B1 | 1/2011 |
| KR | 20120008045 | A | 1/2012 |
| KR | 101192642 | B1 | 10/2012 |
| KR | 20120115581 | A | 10/2012 |
| KR | 20130094646 | A | 8/2013 |
| WO | WO-9515025 | A1 | 6/1995 |
| WO | WO-0073659 | A1 | 12/2000 |
| WO | WO-2007046810 | A2 | 4/2007 |
| WO | WO-2008060525 | A1 | 5/2008 |
| WO | WO-2009017741 | A1 | 2/2009 |
| WO | WO-2009155099 | A2 | 12/2009 |
| WO | WO-2010118140 | A2 | 10/2010 |
| WO | WO-2011106422 | A2 | 9/2011 |
| WO | WO-2012114455 | A1 | 8/2012 |
| WO | WO-2017071641 | A1 | 5/2017 |

OTHER PUBLICATIONS

Notice of Allowance regarding U.S. Appl. No. 17/196,119 dated Apr. 26, 2023.

Advisory Action regarding U.S. Appl. No. 14/073,293, dated Apr. 18, 2016.

Office Action regarding Chinese Patent Application No. 200710160038.5, dated Jan. 31, 2012. Translation provided by Unitalen Attorneys At Law.

Office Action regarding Chinese Patent Application No. 201080020243.1, dated Nov. 5, 2013. Translation provided by Unitalen Attorneys At Law.

Search Report regarding European Patent Application No. 07254962.9, dated Mar. 12, 2008.

Office Action regarding Chinese Patent Application No. 200710160038.5, dated Jul. 8, 2010. Translation provided by Unitalen Attorneys At Law.

Office Action regarding Chinese Patent Application No. 201380059666.8, dated Apr. 5, 2016. Translation provided by Unitalen Attorneys At Law.

International Search Report regarding International Application No. PCT/US2010/030248, dated Nov. 26, 2010.

International Search Report regarding International Application No. PCT/US2011/025921, dated Oct. 7, 2011.

International Search Report regarding International Application No. PCT/US2013/051678, dated Oct. 21, 2013.

International Search Report regarding International Application No. PCT/US2013/069456, dated Feb. 18, 2014.

International Search Report regarding International Application No. PCT/US2013/069462, dated Feb. 21, 2014.

International Search Report regarding International Application No. PCT/US2013/070981, dated Mar. 4, 2014.

International Search Report regarding International Application No. PCT/US2013/070992, dated Feb. 25, 2014.

International Search Report regarding International Application No. PCT/US2015/033960, dated Sep. 1, 2015.

Notice of Allowance regarding U.S. Appl. No. 14/060,240, dated Dec. 1, 2015.

Office Action regarding Chinese Patent Application No. 201410460792.0, dated Feb. 25, 2016. Translation provided by Unitalen Attorneys at Law.

Office Action regarding Chinese Patent Application No. 201410461048.2, dated Nov. 30, 2015. Translation provided by Unitalen Attorneys at Law.

Office Action regarding U.S. Appl. No. 14/081,390, dated Mar. 27, 2015.

Office Action regarding U.S. Appl. No. 14/060,240, dated Aug. 12, 2015.

Office Action regarding U.S. Appl. No. 14/073,293, dated Jan. 29, 2016.

Office Action regarding U.S. Appl. No. 14/073,293, dated Sep. 25, 2015.

Restriction Requirement regarding U.S. Appl. No. 14/060,102, dated Mar. 16, 2016.

Restriction Requirement regarding U.S. Appl. No. 14/060,102, dated Oct. 7, 2015.

Search Report regarding European Patent Application No. 10762374.6, dated Jun. 16, 2015.

Office Action regarding Chinese Patent Application No. 201180010366.1, dated Dec. 31, 2014. Translation provided by Unitalen Attorneys At Law.

Office Action regarding U.S. Appl. No. 11/645,288, dated Nov. 30, 2009.

Office Action regarding U.S. Appl. No. 13/181,065, dated Nov. 9, 2012.

Written Opinion of the International Searching Authority regarding International Application No. PCT/US2013/069462, dated Feb. 21, 2014.

Written Opinion of the International Search Authority regarding International Application No. PCT/US2011/025921, dated Oct. 7, 2011.

(56) References Cited

OTHER PUBLICATIONS

Written Opinion of the International Searching Authority regarding International Application No. PCT/US2010/030248, dated Nov. 26, 2010.
Written Opinion of the International Searching Authority regarding International Application No. PCT/US2013/051678, dated Oct. 21, 2013.
Written Opinion of the International Searching Authority regarding International Application No. PCT/US2013/069456, dated Feb. 18, 2014.
Written Opinion of the International Searching Authority regarding International Application No. PCT/US2013/070981, dated Mar. 4, 2014.
Written Opinion of the International Searching Authority regarding International Application No. PCT/US2013/070992, dated Feb. 25, 2014.
Written Opinion of the International Searching Authority regarding International Application No. PCT/US2015/033960, dated Sep. 1, 2015.
Office Action regarding Chinese Patent Application No. 201380062614.6, dated Apr. 5, 2016. Translation provided by Unitalen Attorneys At Law.
Office Action regarding Chinese Patent Application No. 201380062657.4, dated May 4, 2016. Translation provided by Unitalen Attorneys at Law.
Office Action regarding Chinese Patent Application No. 201380059963.2, dated May 10, 2016. Translation provided by Unitalen Attorneys at Law.
Office Action regarding U.S. Appl. No. 14/060,102, dated Jun. 14, 2016.
Office Action regarding U.S. Appl. No. 14/846,877, dated Jul. 15, 2016.
Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.
Office Action regarding U.S. Appl. No. 14/294,458, dated Aug. 19, 2016.
Office Action regarding Chinese Patent Application No. 201410460792.0, dated Oct. 21, 2016. Translation provided by Unitalen Attorneys At Law.
Search Report regarding European Patent Application No. 11747996.4, dated Nov. 7, 2016.
Office Action regarding Chinese Patent Application No. 201380059666.8, dated Nov. 23, 2016. Translation provided by Unitalen Attorneys at Law.
Office Action regarding U.S. Appl. No. 14/060,102, dated Dec. 28, 2016.
Office Action regarding U.S. Appl. No. 15/156,400, dated Feb. 23, 2017.
Office Action regarding U.S. Appl. No. 14/294,458, dated Feb. 28, 2017.
Advisory Action regarding U.S. Appl. No. 14/060,102, dated Mar. 3, 2017.
Office Action regarding U.S. Appl. No. 14/663,073, dated Apr. 11, 2017.
Office Action regarding Chinese Patent Application No. 201410460792.0, dated Apr. 24, 2017. Translation provided by Unitalen Attorneys at Law.
Office Action regarding U.S. Appl. No. 14/946,824, dated May 10, 2017.
Advisory Action regarding U.S. Appl. No. 14/294,458, dated Jun. 9, 2017.
Office Action regarding Chinese Patent Application No. 201610703191.7, dated Jun. 13, 2017. Translation provided by Unitalen Attorneys at Law.
Office Action regarding Indian Patent Application No. 2043/MUMNP/2011, dated Jul. 28, 2017.
International Search Report regarding International Application No. PCT/CN2016/103763, dated Jan. 25, 2017.
Written Opinion of the International Searching Authority regarding International Application No. PCT/CN2016/103763, dated Jan. 25, 2017.
Office Action regarding U.S. Appl. No. 14/294,458, dated Sep. 21, 2017.
Office Action regarding U.S. Appl. No. 14/757,407, dated Oct. 13, 2017.
Office Action regarding Chinese Patent Application No. 201410460792.0, dated Nov. 1, 2017. Translation provided by Unitalen Attorneys At Law.
Office Action regarding Chinese Patent Application No. 201610158216.X, dated Oct. 30, 2017. Translation provided by Unitalen Attorneys at Law.
Office Action regarding Chinese Patent Application No. 201610512702.7, dated Dec. 20, 2017. Partial translation provided by Unitalen Attorneys at Law.
Office Action regarding Chinese Patent Application No. 201610499158.7, dated Jan. 9, 2018. Translation provided by Unitalen Attorneys at Law.
Office Action regarding Chinese Patent Application No. 201580029636.1, dated Jan. 17, 2018. Translation provided by Unitalen Attorneys at Law.
Office Action regarding U.S. Appl. No. 15/651,471, dated Feb. 23, 2018.
Office Action regarding U.S. Appl. No. 15/646,654, dated Feb. 9, 2018.
Office Action regarding Indian Patent Application No. 1907/MUMNP/2012, dated Feb. 26, 2018.
Restriction Requirement regarding U.S. Appl. No. 15/784,458, dated Apr. 5, 2018.
Restriction Requirement regarding U.S. Appl. No. 15/186,092, dated Apr. 3, 2018.
Office Action regarding U.S. Appl. No. 15/186,151, dated May 3, 2018.
Restriction Requirement regarding U.S. Appl. No. 15/187,225, dated May 15, 2018.
Notice of Allowance regarding U.S. Appl. No. 14/757,407, dated May 24, 2018.
Office Action regarding Chinese Patent Application No. 201610930347.5, dated May 14, 2018. Translation provided by Unitalen Attorneys at Law.
Office Action regarding U.S. Appl. No. 15/186,092, dated Jun. 29, 2018.
Notice of Allowance regarding U.S. Appl. No. 15/646,654, dated Jul. 11, 2018.
Notice of Allowance regarding U.S. Appl. No. 15/651,471, dated Jul. 11, 2018.
Office Action regarding Korean Patent Application No. 10-2016-7034539, dated Apr. 11, 2018. Translation provided by Y.S. Chang & Associates.
Office Action regarding Chinese Patent Application No. 201610158216.X, dated Jun. 13, 2018. Translation provided by Unitalen Attorneys at Law.
Office Action regarding U.S. Appl. No. 15/784,540, dated Jul. 17, 2018.
Office Action regarding European Patent Application No. 13859308.2, dated Jun. 22, 2018.
Office Action regarding U.S. Appl. No. 15/784,458, dated Jul. 19, 2018.
Restriction Requirement regarding U.S. Appl. No. 15/587,735, dated Jul. 23, 2018.
Interview Summary regarding U.S. Appl. No. 15/186,092, dated Aug. 14, 2018.
Office Action regarding U.S. Appl. No. 15/187,225, dated Aug. 27, 2018.
Office Action regarding Indian Patent Application No. 1307/MUMNP/2015, dated Sep. 12, 2018.

(56) References Cited

OTHER PUBLICATIONS

Office Action regarding Chinese Patent Application No. 201610499158.7, dated Aug. 1, 2018. Translation provided by Unitalen Attorneys at Law.
Office Action regarding Korean Patent Application No. 10-2016-7034539, dated Sep. 6, 2018. Translation provided by Y.S. Chang & Associates.
Office Action regarding U.S. Appl. No. 15/587,735, dated Oct. 9, 2018.
Office Action regarding U.S. Appl. No. 11/522,250, dated Aug. 1, 2007.
Office Action regarding Chinese Patent Application No. 200710153687.2, dated Mar. 6, 2009. Translation provided by CCPIT Patent and Trademark Law Office.
Office Action regarding U.S. Appl. No. 12/103,265, dated May 27, 2009.
Office Action regarding U.S. Appl. No. 12/103,265, dated Dec. 17, 2009.
Office Action regarding Korean Patent Application No. 10-2007-0093478, dated Feb. 25, 2010. Translation provided by Y.S. Chang & Associates.
Office Action regarding U.S. Appl. No. 12/103,265, dated Jun. 15, 2010.
Office Action regarding Korean Patent Application No. 10-2007-0093478, dated Aug. 31, 2010. Translation provided by Y.S. Chang & Associates.
Advisory Action regarding U.S. Appl. No. 12/103,265, dated Sep. 17, 2010.
Office Action regarding Chinese Patent Application No. 201010224582.3, dated Apr. 17, 2012. Translation provided by Unitalen Attorneys at Law.
Office Action regarding Indian Patent Application No. 1071/KOL/2007, dated Apr. 27, 2012.
Office Action regarding U.S. Appl. No. 13/036,529, dated Aug. 22, 2012.
International Search Report regarding International Application No. PCT/US2015/042479, dated Oct. 23, 2015.
Written Opinion of the International Searching Authority regarding International Application No. PCT/US2015/042479, dated Oct. 23, 2015.
Restriction Requirement regarding U.S. Appl. No. 14/809,786, dated Aug. 16, 2017.
International Search Report regarding International Application No. PCT/US2017/050525, dated Dec. 28, 2017.
Written Opinion of the International Searching Authority regarding International Application No. PCT/US2017/050525, dated Dec. 28, 2017.
Office Action regarding U.S. Appl. No. 14/809,786, dated Jan. 11, 2018.
Office Action regarding Chinese Patent Application No. 201580041209.5, dated Jan. 17, 2018. Translation provided by Unitalen Attorneys at Law.
Office Action regarding Chinese Patent Application No. 201710795228.8, dated Sep. 5, 2018. Translation provided by Unitalen Attorneys at Law.
Office Action regarding Chinese Patent Application No. 201580029636.1, dated Oct. 8, 2018. Translation provided by Unitalen Attorneys at Law.
Office Action regarding U.S. Appl. No. 15/186,151, dated Nov. 1, 2018.
Luckevich, Mark, "MEMS microvalves: the new valve world." Valve World, May 2007, pp. 79-83.
Office Action regarding Korean Patent Application No. 10-2017-7033995, dated Nov. 29, 2018. Translation provided by Ks Koryo International IP Law Firm.
Office Action regarding Indian Patent Application No. 1306/MUMNP/2015, dated Dec. 31, 2018.
Notice of Allowance regarding U.S. Appl. No. 15/187,225, dated Jan. 3, 2019.
Notice of Allowance regarding U.S. Appl. No. 15/186,092, dated Dec. 20, 2018.
Notice of Allowance regarding U.S. Appl. No. 15/784,458, dated Feb. 7, 2019.
Notice of Allowance regarding U.S. Appl. No. 15/784,540, dated Feb. 7, 2019.
Office Action regarding Chinese Patent Application No. 201610516097.0, dated Jun. 27, 2017. Translation provided by Unitalen Attorneys at Law.
Search Report regarding European Patent Application No. 18198310.7, dated Feb. 27, 2019.
Office Action regarding Chinese Patent Application No. 201610499158.7, dated Feb. 1, 2019. Translation provided by Unitalen Attorneys at Law.
Office Action regarding Chinese Patent Application No. 201180010366.1, dated Jun. 4, 2014. Translation provided by Unitalen Attorneys at Law.
Notice of Allowance regarding U.S. Appl. No. 15/186,151, dated Mar. 19, 2019.
Office Action regarding Chinese Patent Application No. 201710795228.8, dated Apr. 29, 2019. Translation provided by Unitalen Attorneys at Law.
Office Action regarding U.S. Appl. No. 15/587,735, dated May 17, 2019.
Notice of Allowance regarding U.S. Appl. No. 15/187,225, dated May 2, 2019.
Notice of Allowance regarding U.S. Appl. No. 15/186,092, dated Apr. 19, 2019.
Office Action regarding European Patent Application No. 11747996.4, dated Jun. 26, 2019.
Office Action regarding Chinese Patent Application No. 201811011292.3, dated Jun. 21, 2019. Translation provided by Unitalen Attorneys at Law.
Notice of Allowance regarding U.S. Appl. No. 15/186,151, dated Jul. 25, 2019.
Notice of Allowance regarding U.S. Appl. No. 15/587,735, dated Aug. 23, 2019.
Office Action regarding U.S. Appl. No. 15/692,844, dated Sep. 20, 2019.
Office Action regarding Chinese Patent Application No. 201610499158.7, dated Aug. 1, 2019. Translation provided by Unitalen Attorneys at Law.
Office Action regarding Chinese Patent Application No. 201780055443.2, dated Sep. 2, 2019. Translation provided by Unitalen Attorneys at Law.
Restriction Requirement regarding U.S. Appl. No. 15/682,599, dated Aug. 14, 2019.
Office Action regarding Chinese Patent Application No. 201811168307.7, dated Aug. 12, 2019. Translation provided by Unitalen Attorneys at Law.
International Search Report regarding International Application No. PCT/US2019/032718, dated Aug. 23, 2019.
Written Opinion of the International Searching Authority regarding International Application No. PCT/US2019/032718, dated Aug. 23, 2019.
Office Action regarding European Patent Application No. 11747996.4, dated Nov. 5, 2019.
Notice of Allowance regarding U.S. Appl. No. 15/186,151, dated Nov. 14, 2019.
Office Action regarding Chinese Patent Application No. 201710795228.8, dated Oct. 28, 2019. Translation provided by Unitalen Attorneys at Law.
Office Action regarding U.S. Appl. No. 15/682,599, dated Jan. 24, 2020.
Office Action regarding U.S. Appl. No. 15/881,016, dated Jan. 23, 2020.
Office Action regarding U.S. Appl. No. 15/831,423, dated Jan. 31, 2020.
Office Action regarding Chinese Patent Application No. 201811480347.5, dated Jan. 10, 2020. Translation provided by Unitalen Attorneys at Law.
Office Action regarding European Patent Application No. 11747996.4, dated Jan. 14, 2020.

(56) References Cited

OTHER PUBLICATIONS

Office Action regarding Indian Patent Application No. 2043/MUMNP/2011, dated Nov. 27, 2019.
Office Action regarding Chinese Patent Application No. 201811541653.5, dated Jan. 10, 2020. Translation provided by Unitalen Attorneys at Law.
Notice of Allowance regarding U.S. Appl. No. 15/692,844, dated Feb. 20, 2020.
Office Action regarding Chinese Patent Application No. 201811168307.7, dated Mar. 27, 2020. Translation provided by Unitalen Attorneys at Law.
Office Action regarding European Patent Application No. 13859308.2, dated Mar. 4, 2020.
Office Action regarding Korean Patent Application No. 10-2018-0159231, dated Apr. 7, 2020. Translation provided by Ks Koryo International IP Law Firm.
Notice of Allowance regarding U.S. Appl. No. 15/682,599, dated Apr. 22, 2020.
Office Action regarding Chinese Patent Application No. 201780055443.2, dated Apr. 14, 2020. Translation provided by Unitalen Attorneys At Law.
Notice of Allowance regarding U.S. Appl. No. 15/831,423, dated May 20, 2020.
Restriction Requirement regarding U.S. Appl. No. 16/147,920, dated Jun. 25, 2020.
Notice of Allowance regarding U.S. Appl. No. 15/692,844, dated Jun. 4, 2020.
Office Action regarding U.S. Appl. No. 16/154,406, dated Jun. 29, 2020.
Restriction Requirement regarding U.S. Appl. No. 16/154,844, dated Jul. 2, 2020.
International Search Report regarding International Application No. PCT/US2020/022030, dated Jul. 2, 2020.
Written Opinion of the International Searching Authority regarding International Application No. PCT/US2020/022030, dated Jul. 2, 2020.
Office Action regarding U.S. Appl. No. 16/177,902, dated Jul. 23, 2020.
Office Action regarding U.S. Appl. No. 15/881,016, dated Jul. 21, 2020.
Office Action regarding Chinese Patent Application No. 201811480347.5, dated Jul. 21, 2020. Translation provided by Unitalen Attorneys at Law.
Notice of Allowance regarding U.S. Appl. No. 16/154,406, dated Oct. 2, 2020.
Office Action regarding U.S. Appl. No. 16/154,844, dated Oct. 5, 2020.
Office Action regarding U.S. Appl. No. 16/147,920, dated Sep. 25, 2020.
Notice of Allowance regarding U.S. Appl. No. 15/881,016, dated Nov. 17, 2020.
Notice of Allowance regarding U.S. Appl. No. 16/177,902, dated Nov. 27, 2020.
Notice of Allowance regarding U.S. Appl. No. 16/147,920, dated Feb. 2, 2021.
Notice of Allowance regarding U.S. Appl. No. 16/154,844, dated Feb. 10, 2021.
Heatcraft RPD; How and Why we use Capacity Control; dated Jan. 17, 2016; 12 Pages.
Non-Final Office Action regarding U.S. Appl. No. 17/176,080 dated Mar. 30, 2022.
First Chinese Office Action & Search Report regarding Application No. 201980040745.1 dated Jan. 6, 2022. English translation provided by Unitalen Attorneys at Law.
Non-Final Office Action regarding U.S. Appl. No. 17/388,923 dated Jun. 9, 2022.
Notice of Allowance regarding U.S. Appl. No. 17/157,588 dated Jun. 16, 2022.
Final Office Action regarding U.S. Appl. No. 17/176,080 dated Aug. 12, 2022.
Advisory Action regarding U.S. Appl. No. 17/176,080 dated Oct. 17, 2022.
Performance of the Use of Plastics in Oil-Free Scroll Compressors, Shaffer et al., 2012.

* cited by examiner

SCROLL COMPRESSOR WITH CENTER HUB

FIELD

The present disclosure relates to a scroll compressor with a center hub.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., a refrigerant) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure and is not a comprehensive disclosure of its full scope or all of its features.

The present disclosure provides a compressor that may include a shell assembly, a non-orbiting scroll, an orbiting scroll, a hub plate, a primary discharge valve assembly, and a secondary discharge valve assembly. The non-orbiting scroll is disposed within the shell assembly and includes a first end plate and a first spiral wrap. The first end plate includes a primary discharge passage and a secondary discharge passage located radially outward relative to the primary discharge passage. The orbiting scroll is disposed within the shell assembly and includes a second end plate having a second spiral wrap extending therefrom and meshingly engaged with the first spiral wrap. The hub plate may be mounted to the non-orbiting scroll and may include a main body and a central hub extending axially from the main body. The central hub may include a recess and a hub aperture. The hub aperture may be in selective fluid communication with the primary and secondary discharge passages. The primary discharge valve assembly may include a retainer and a primary valve member. The retainer may be disposed at least partially within the recess of the hub plate. The retainer may include a retainer aperture in fluid communication with the hub aperture. The primary valve member may be slidably engaged with the retainer. When the primary valve member is in a closed position, the primary valve member may restrict fluid flow between the discharge chamber and the primary discharge passage. The secondary discharge valve assembly may include a secondary valve member disposed between the hub plate and the first end plate. The secondary valve member may be movable relative to the hub plate and the first end plate. When the secondary valve member is in an open position, fluid is allowed to flow from the secondary discharge passage around an outer periphery of the retainer of the primary discharge valve assembly and through the hub aperture. When the secondary valve member is in a closed position, the secondary valve member restricts fluid communication between the secondary discharge passage and the hub aperture of the central hub.

In some configurations of the compressor of the above paragraph, the first end plate of the non-orbiting scroll includes an annular rim that surrounds an outer periphery of the hub plate and defines a recess in which the hub plate is received.

In some configurations, the compressor of either of the above paragraphs may include a floating seal assembly at least partially received in the recess defined by the annular rim.

In some configurations of the compressor of any one or more of the above paragraphs, the floating seal assembly, the annular rim, and the hub plate cooperate to define a biasing chamber that receives intermediate-pressure working fluid from an aperture in the first end plate.

In some configurations of the compressor of any one or more of the above paragraphs, the primary valve member is a cup-shaped member that slidably engages an inner hub of the retainer.

In some configurations of the compressor of any one or more of the above paragraphs, the inner hub of the retainer includes a central aperture. The retainer aperture and the hub aperture may be disposed radially outward relative to the central aperture.

In some configurations of the compressor of any one or more of the above paragraphs, the retainer includes external threads that threadably engages internal threads formed on the central hub of the hub plate.

In some configurations of the compressor of any one or more of the above paragraphs, the hub aperture is disposed radially outward relative to the internal threads of the hub plate.

In some configurations of the compressor of any one or more of the above paragraphs, a first axial end of the retainer contacts an annular ledge. The hub aperture may be disposed radially outward relative to the annular ledge.

In some configurations of the compressor of any one or more of the above paragraphs, the primary discharge valve assembly includes a spring disposed between the first end plate and a second axial end of the retainer, and wherein the spring biases the retainer into contact with the annular ledge.

In some configurations of the compressor of any one or more of the above paragraphs, the secondary valve member is a reed valve including a fixed end and a movable end that is resiliently bendable relative to the fixed end.

In some configurations, the compressor of any one or more of the above paragraphs may include a drive bearing formed from a polymeric material and a main bearing formed from aluminum. The drive bearing may engage a cylindrical hub of the orbiting scroll and may surround a crank pin of a crankshaft. The main bearing may rotatably support a main body of the crankshaft.

In some configurations of the compressor of any one or more of the above paragraphs, the hub aperture has a larger area than a sum of areas of the secondary discharge passages.

In another form, the present disclosure provides a compressor that may include a shell assembly, a non-orbiting scroll, an orbiting scroll, a hub plate, a primary valve member, and a secondary discharge valve assembly. The non-orbiting scroll is disposed within the shell assembly and including a first end plate and a first spiral wrap. The first end plate includes a primary discharge passage and a secondary discharge passage located radially outward relative to the primary discharge passage. The orbiting scroll is disposed within the shell assembly and includes a second end plate having a second spiral wrap extending therefrom and meshingly engaged with the first spiral wrap. The hub plate may be mounted to the non-orbiting scroll and may include a main body and a central hub extending axially from the main body. The central hub may include a recess and a hub aperture. The hub aperture may be in selective fluid communication with the primary and secondary discharge passages. The central hub may include an integrally formed valve retainer. The primary valve member may be slidably received within the recess of the hub plate. The hub aperture may be disposed radially outward relative to the primary valve member. When the primary valve member is in a closed position, the primary valve member restricts fluid flow between the discharge chamber and the primary discharge passage. The secondary discharge valve assembly may include a secondary valve member disposed between the hub plate and the first end plate. The secondary valve member may be movable relative to the hub plate and the first end plate. When the secondary valve member is in an open position, fluid is allowed to flow from the secondary discharge passage through the hub aperture. When the secondary valve member is in a closed position, the secondary valve member restricts fluid communication between the secondary discharge passage and the hub aperture.

In some configurations of the compressor of the above paragraph, the first end plate of the non-orbiting scroll includes an annular rim that surrounds an outer periphery of the hub plate and defines a recess in which the hub plate is received.

In some configurations, the compressor of either of the above paragraphs includes a floating seal assembly at least partially received in the recess defined by the annular rim.

In some configurations of the compressor of any one or more of the above paragraphs, the floating seal assembly, the annular rim, and the hub plate cooperate to define a biasing chamber that receives intermediate-pressure working fluid from an aperture in the first end plate.

In some configurations of the compressor of any one or more of the above paragraphs, the primary valve member is a cylindrical member.

In some configurations of the compressor of any one or more of the above paragraphs, the valve retainer includes a central aperture. The hub aperture may be disposed radially outward relative to the central aperture.

In some configurations of the compressor of any one or more of the above paragraphs, the secondary valve member is a reed valve including a fixed end and a movable end that is resiliently bendable relative to the fixed end.

In some configurations, the compressor of any one or more of the above paragraphs may include a drive bearing formed from a polymeric material and a main bearing formed from aluminum. The drive bearing may engage a cylindrical hub of the orbiting scroll and may surround a crank pin of a crankshaft. The main bearing may rotatably support a main body of the crankshaft.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
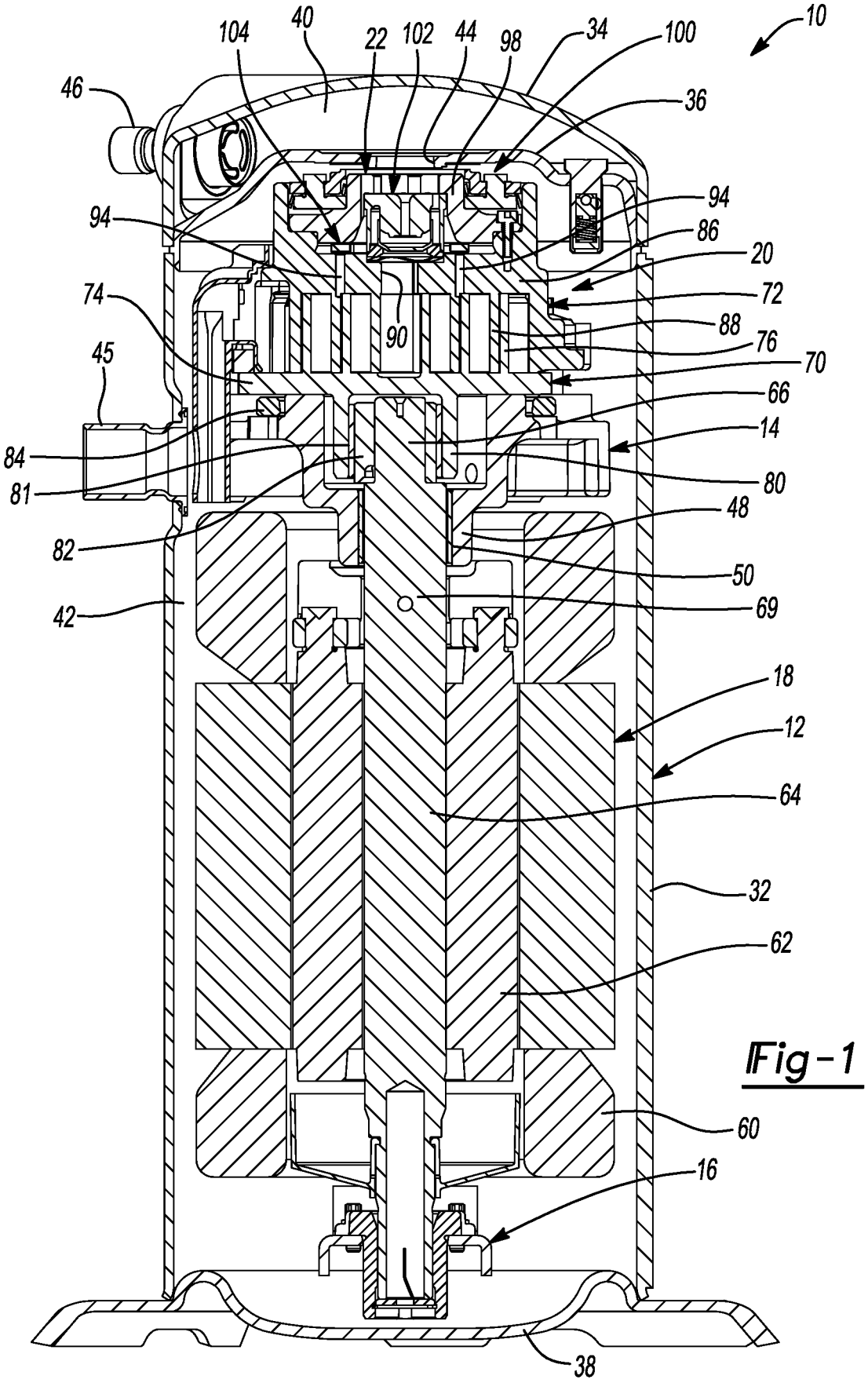
FIG. 1 is a cross-sectional view of a compressor according to the principles of the present disclosure.

Example embodiments will now be described more fully with reference to the accompanying drawings.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-5, a compressor 10 is provided that may include a hermetic shell assembly 12, first and second bearing-housing assemblies 14, 16, a motor assembly 18, a compression mechanism 20, and a hub assembly 22.

The shell assembly 12 may form a compressor housing and may include a cylindrical shell 32, an end cap 34 at an upper end thereof, a transversely extending partition 36, and a base 38 at a lower end thereof. The end cap 34 and the partition 36 may define a discharge chamber 40. The partition 36 may separate the discharge chamber 40 from a suction chamber 42. A discharge passage 44 may extend through the partition 36 to provide communication between the compression mechanism 20 and the discharge chamber 40. A suction fitting 45 may provide fluid communication between the suction chamber 42 and a low side of a system in which the compressor 10 is installed. A discharge fitting 46 may provide fluid communication between the discharge chamber 40 and a high side of the system in which the compressor 10 is installed.

The first bearing-housing assembly 14 may be fixed relative to the shell 32 and may include a main bearing-housing 48 and a main bearing 50. The main bearing-housing 48 may axially support the compression mechanism 20 and may house the main bearing 50 therein. The main bearing-housing 48 may include a plurality of radially extending arms engaging the shell 32. The main bearing 50 may be formed from aluminum (or aluminum alloys), for example, or other suitable materials.

The motor assembly 18 may include a motor stator 60, a rotor 62, and a driveshaft 64. The motor stator 60 may be press fit into the shell 32. The rotor 62 may be press fit on the driveshaft 64 and may transmit rotational power to the driveshaft 64. The driveshaft 64 may be rotatably supported by the first and second bearing-housing assemblies 14, 16. The driveshaft 64 may include an eccentric crank pin 66 having a flat surface thereon. A main body 69 of the driveshaft 64 may be rotatably supported by the main bearing 50 and main-bearing housing 48.

The compression mechanism 20 may include an orbiting scroll 70 and a non-orbiting scroll 72. The orbiting scroll 70 may include an end plate 74 and a spiral wrap 76 extending therefrom. A cylindrical hub 80 may project downwardly from the end plate 74 and may include a drive bushing 82 disposed therein. A drive bearing 81 may also be disposed within the hub 80 and may surround the drive bushing 82 and the crank pin 66 (i.e., the drive bearing 81 may be disposed radially between the hub 80 and the drive bushing 82). The drive bearing 81 may be formed from a polymeric material, for example, or any other suitable material. The drive bushing 82 may include an inner bore in which the crank pin 66 is drivingly disposed. The crank pin flat may drivingly engage a flat surface in a portion of the inner bore to provide a radially compliant driving arrangement. An Oldham coupling 84 may be engaged with the orbiting and non-orbiting scrolls 70, 72 to prevent relative rotation therebetween.

The non-orbiting scroll 72 may include an end plate 86 and a spiral wrap 88 projecting downwardly from the end plate 86. The spiral wrap 88 may meshingly engage the spiral wrap 76 of the orbiting scroll 70, thereby creating a series of moving fluid pockets (e.g., fluid pockets 89, 91, 97). The fluid pockets 89, 91, 97 defined by the spiral wraps 76, 88 may decrease in volume as they move from a radially outer position (at a suction pressure) to radially intermediate positions (at intermediate pressures between suction pressure and discharge pressure) to a radially inner position (at a discharge pressure) throughout a compression cycle of the compression mechanism 20. The non-orbiting scroll 72 may be formed from steel, cast iron, or aluminum, for example, or any other suitable material.

Figure 2:
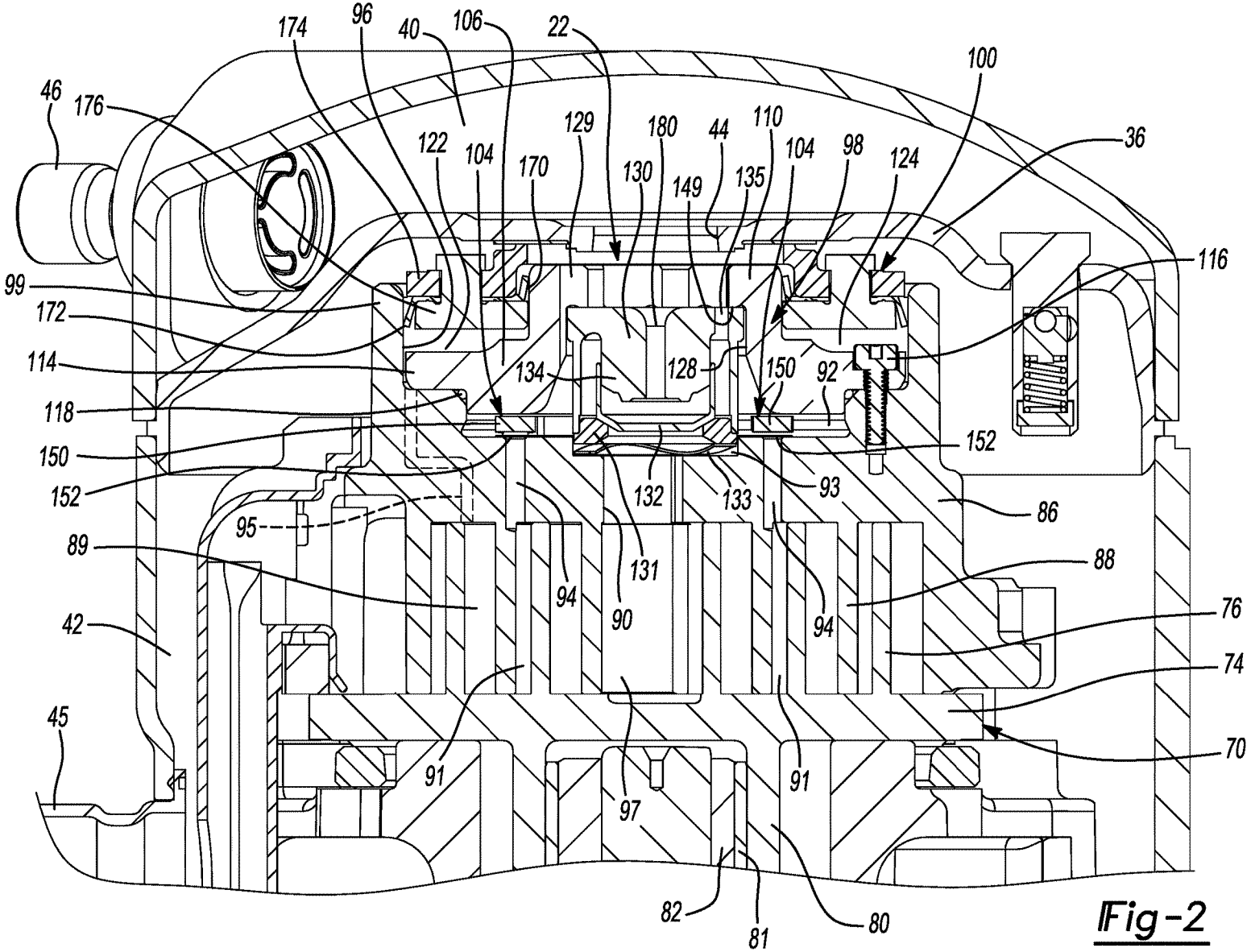
FIG. 2 is a cross-sectional view of a portion of the compressor of FIG. 1 with primary and secondary discharge valve members in closed positions.
Figure 3:
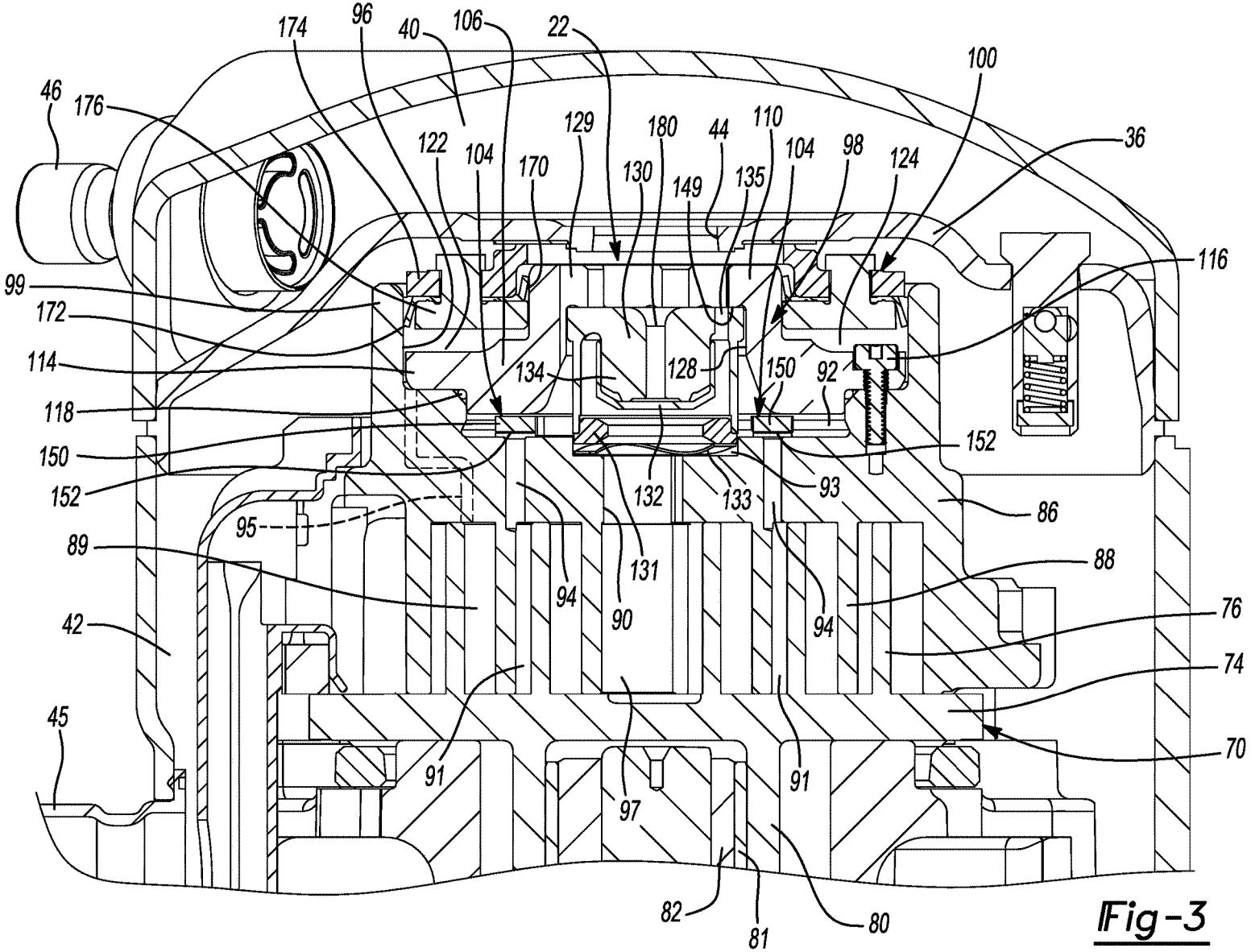
FIG. 3 is a cross-sectional view of a portion of the compressor of FIG. 1 with primary and secondary discharge valve members in open positions.

As shown in FIG. 2, the end plate 86 may include a primary discharge passage 90, a first discharge recess 92, a second discharge recess 93, one or more first apertures (e.g., variable-compression-ratio apertures or secondary discharge passages) 94, a second aperture (e.g., axial biasing aperture) 95, and an annular recess 96. The discharge passage 90 may be in communication with the fluid pocket 97 (e.g., a discharge-pressure pocket) at the radially inner position and allows compressed working fluid (at the discharge pressure) to flow through the hub assembly 22 and into the discharge chamber 40. The second discharge recess 93 may be in fluid communication with the discharge passage 90. The first discharge recess 92 may be an annular recess that is disposed radially outward relative to the second discharge recess 93. The second discharge recess 93 may be disposed between the discharge passage 90 and the first discharge recess 92. The first apertures 94 may be disposed radially outward relative to the discharge passage 90 and may selectively allow fluid communication between the fluid pockets 91 at radially intermediate positions (e.g., intermediate-pressure fluid pockets 91) and the first discharge recess 92. The second aperture 95 may be disposed radially outward relative to the discharge passage 90. The second aperture 95 may be disposed radially outward to relative to the first apertures 94 and may be rotationally offset from the first apertures 94. The second aperture 95 may provide communication between one of the fluid pockets 89 at a radially intermediate position (e.g., at an intermediate pressure that may be lower than the intermediate pressures of pockets 91) and the annular recess 96. The annular recess 96 may be defined by an annular rim 99 of the end plate 86 of the non-orbiting scroll. The annular recess 96 may encircle the first and second discharge recesses 92, 93 and may be substantially concentric therewith.

The hub assembly 22 may be mounted to the end plate 86 of the non-orbiting scroll 72 on a side of the end plate 86 opposite the spiral wrap 88. As shown in FIGS. 2-5, the hub assembly 22 may include a hub plate 98, a seal assembly 100, a primary discharge valve assembly 102, and one or more secondary discharge valve assemblies (or variable compression ratio valve assemblies) 104.

The hub plate 98 may include a main body 106, a central hub 110, and a mounting flange 114. The main body 106 may extend partially into the first discharge recess 92. The central hub 110 may extend axially from a radially inner portion of the main body 106. The mounting flange may extend radially outward from the main body 106 and may receive bolts 116 that secure the hub plate 98 to the end plate 86 of the non-orbiting scroll 72. An annular gasket 118 may surround the first discharge recess 92 in the end plate 86 and may be disposed between and sealingly engage the main body 106 and the end plate 86. The hub plate 98 may be formed from steel, cast iron, or aluminum, for example, or any other suitable material. The hub plate 98 may be formed from the same material as the non-orbiting scroll 72, or the hub plate 98 may be formed from a different material than the non-orbiting scroll 72.

The annular rim 99 and the central hub 110 may cooperate with the main body 106 to define an annular recess 122 (FIG. 2) that may movably receive the seal assembly 100 therein. The seal assembly 100 may sealingly engage the partition 36 (as shown in FIG. 2). The annular recess 122 may cooperate with the seal assembly 100 to define an annular biasing chamber 124 therebetween. The biasing chamber 124 receives fluid from the intermediate fluid pocket 89 via second aperture 95 (e.g., fluid may flow from the second aperture 95 around the outer periphery of the mounting flange 114 and/or through an aperture in the hub plate 98). A pressure differential between the intermediate-pressure fluid in the biasing chamber 124 and suction-pressure fluid in the suction chamber 42 exerts a net axial biasing force on the hub plate 98 and non-orbiting scroll 72 urging the non-orbiting scroll 72 toward the orbiting scroll 70, while still allowing axial compliance of the non-orbiting scroll 72 relative to the orbiting scroll 70 and the partition 36. In this manner, the tips of the spiral wrap 88 of the non-orbiting scroll 72 are urged into sealing engagement with the end plate 74 of the orbiting scroll 70 and the end plate 86 of the non-orbiting scroll 72 is urged into sealing engagement with the tips of the spiral wrap 76 of the orbiting scroll 70. This pressure differential also urges the seal assembly 100 into engagement with the partition 36.

Figure 4:
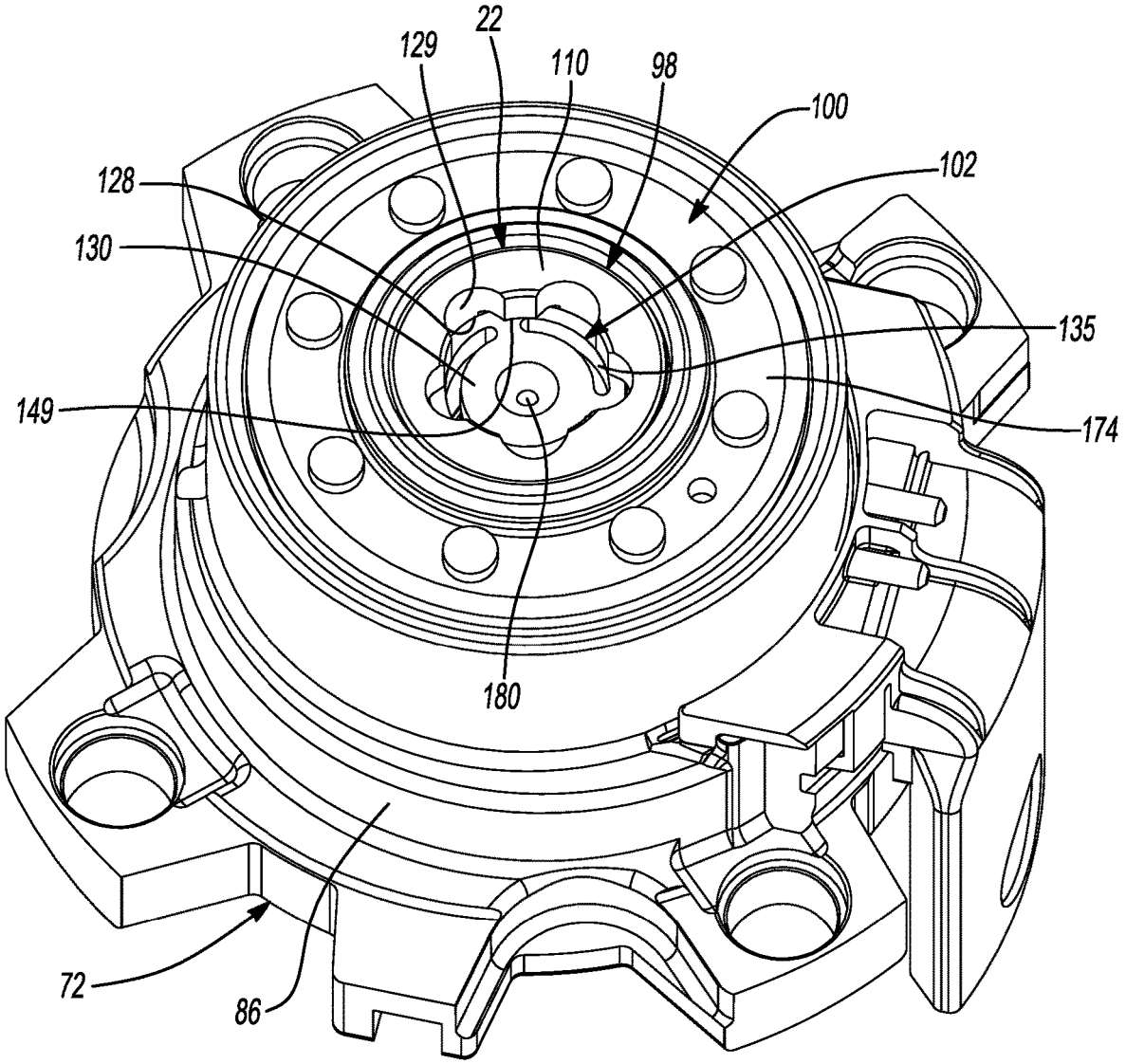
FIG. 4 is a perspective view of a non-orbiting scroll of the compressor with a hub assembly according to the principles of the present disclosure.
Figure 5:
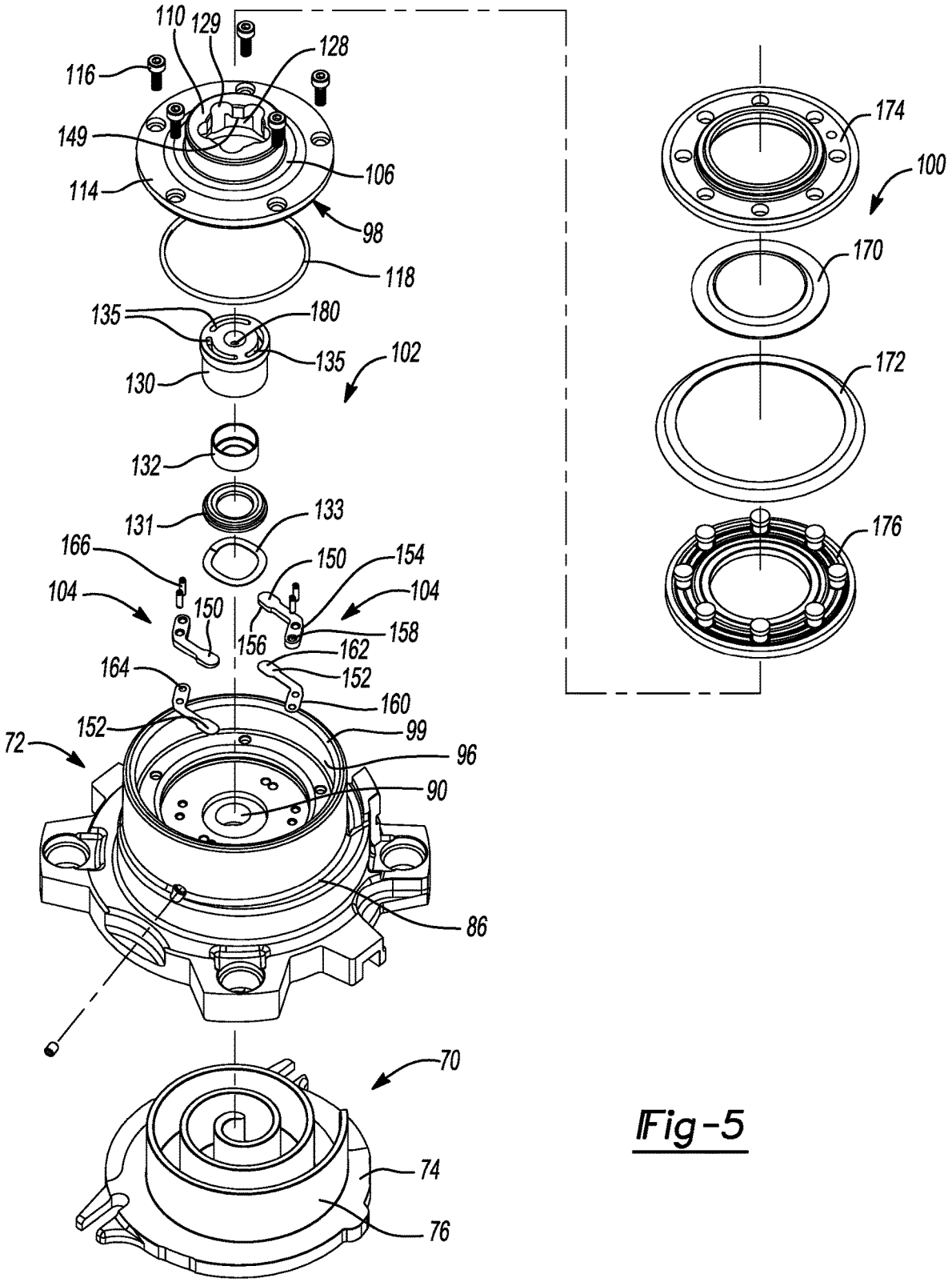
FIG. 5 is an exploded view of orbiting and non-orbiting scrolls and the hub assembly.

The central hub 110 may define a recess 128 and one or more hub apertures 129 through which the recess 128 fluidly communicates with the discharge chamber 40. The aperture 129 may be disposed axially between the recess 128 and the discharge passage 44 of the partition 36. The aperture 129 may include a plurality of scallop-shaped cutouts, as shown in FIGS. 4 and 5. The recess 128 may at least partially receive the primary discharge valve assembly 102. The recess 128 may be in fluid communication with the first discharge recess 92 in the non-orbiting scroll 72 and in selective fluid communication with the first apertures 94 in the non-orbiting scroll 72.

The primary discharge valve assembly 102 may include a retainer (or valve body) 130 and a primary valve member 132 that is movable relative to the retainer 130. In some configurations, the primary discharge valve assembly 102 may also include an annular valve seat 131 and a spring 133 (e.g., a wave ring or coil spring, for example). The valve seat 131 has an inner diameter that may be sized to provide a desired flow area for discharging working fluid from the compression mechanism 20. In some configurations, the size, shape, and number of the scalloped-shaped cutouts of the aperture 129 may be selected to provide a flow area of the aperture 129 (around the radially outer periphery of the retainer 130) that is (or multiple flow areas having a sum that is) equal to or greater than the sum of flow areas defined by the diameters of the first apertures 94.

The retainer 130 may be received in the recess 128 of the hub plate 98. The retainer 130 may include an inner hub 134 and one or more retainer apertures 135 that surround the inner hub 134. The valve seat 131 may engage an axial end of the retainer 130 and may be received in the second discharge recess 93. The valve member 132 movably engages an inner hub 134 of the retainer 130 and selectively seats against the valve seat 131. For example, the valve member 132 may be a cup-shaped member that movably receives the inner hub 134. The valve member 132 may be spaced apart from the valve seat 131 during normal operation of the compressor 10 to allow fluid to flow from the compression mechanism 20 to the discharge chamber 40. That is, when the valve member 132 is in an open position (i.e., when the valve member 132 is spaced apart from the valve seat 131; shown in FIG. 3) fluid is allowed to flow from the discharge passage 90, through the valve seat 131, through the apertures 135, through the aperture 129, and through the discharge passage 44 and into the discharge chamber 40. The valve member 132 may move downward to a closed position (in which the valve member 132 contacts the valve seat 131; shown in FIG. 2) after shutdown of the compressor 10 to restrict or prevent fluid from flowing from the discharge chamber 40 back into the compression mechanism 20 through the discharge passage 90. The spring 133 may be disposed within the second discharge recess 93 and may contact the end plate 86 and the valve seat 131. The spring 133 may bias the valve seat 131 and retainer 130 upward against an annular ledge 149 (e.g., an axially facing surface) defining an axial end of the recess 128.

The secondary discharge valve assemblies 104 may be disposed within the first discharge recess 92 and between the hub plate 98 and the non-orbiting scroll 72. Each of the secondary discharge valve assemblies 104 may include a retainer (or valve backer) 150 and a secondary valve member 152 (e.g., a resiliently flexible reed valve). The retainer 150 may be pinned, bolted, or otherwise attached to the end plate 86. The retainer 150 may be sandwiched between the end plate 86 and the hub plate 98.

As shown in FIG. 5, the valve retainers 150 may include a base portion 154 and an arm portion 156 that extends at an angle from the base portion 154. The base portion 154 may include a pair of pin bores 158. A distal end of the arm portion 156 includes an inclined surface that faces the valve member 152. The valve members 152 may be reed valve members that are thin, resiliently flexible members shaped to correspond to the shape of the valve retainers 150. The valve members 152 may include a fixed end 160 and a movable end 162. The fixed end 160 may include a pair of pin bores 164 that are coaxially aligned with pin bores 158 in a corresponding one of the valve retainers 150 and a corresponding pair of pin bores in the end plate 86 of the non-orbiting scroll 72. Mounting pins (or other fasteners) 166 may be press fit (or otherwise received) in the pin bores in the retainers 150, valve members, and end plate 86 to secure the secondary discharge valve assemblies 104 to the end plate 86.

The movable ends 162 of the valve members 152 are deflectable relative to the fixed ends 160 between a closed position (FIG. 2) in which the movable ends 162 sealingly seat against the end plate 86 to restrict or prevent fluid flow through respective first apertures 94 and an open position (FIG. 3) in which the movable ends 162 are deflected upward away from the end plate 86 and toward the valve retainers 150 to allow fluid to flow through the respective apertures 94 and up into the recess 128 in the central hub 110 of the hub plate 98.

It will be appreciated that the secondary discharge valve assembly 104 could be configured in any other manner to selectively allow and restrict fluid flow through the first apertures 94. For example, instead of valve members 152 and retainers 150, the secondary discharge valve assemblies 104 could include a biasing member (a spring) and an annular valve member. Other types and/or configurations of valves could be employed to control fluid flow through the first apertures 94.

The seal assembly 100 may be a floating seal assembly. For example, the seal assembly 100 may be formed from one or more annular flexible seals 170, 172 and one or more annular rigid seal plates 174, 176. The seal assembly 100 may be received in the biasing chamber 124 between the annular rim 99 and the central hub 110 of the hub plate 98. The seal assembly 100 may sealingly engage the annular rim 99 and the central hub 110. As described above, during operation of the compressor 10, the seal assembly 100 may contact the partition 36 to seal the discharge chamber 40 from the suction chamber 42.

With continued reference to FIGS. 1-5, operation of the compressor 10 will be described in detail. During normal operation of the compressor 10, low-pressure fluid may be received into the compressor 10 via the suction fitting 45 and may be drawn into the compression mechanism 20, where the fluid is compressed in the fluid pockets defined by spiral wraps 76, 88, as described above. Fluid may be discharged from the compression mechanism 20 at a relatively high discharge pressure through the discharge passage 90. Discharge-pressure fluid flows from the discharge passage 90, through the second discharge recess 93, through the primary discharge valve assembly 102 (i.e., the discharge-pressure fluid forces the valve member 132 upward away from the valve seat 131 to allow the fluid to flow through apertures 135 in the valve retainer 130), through aperture 129, and into the discharge chamber 40, where the fluid then exits the compressor 10 through the discharge fitting 46. When the compressor shuts down, fluid may flow into a central aperture 180 in the retainer 130 to force the valve member 132 back to the closed position (i.e., into engagement with the valve seat 131).

Over-compression is a compressor operating condition where the internal compression ratio of the compressor (i.e., a ratio of a pressure of the compression pocket at the radially innermost position to a pressure of the compression pocket at the radially outermost position) is higher than a pressure ratio of a system in which the compressor is installed (i.e., a ratio of a pressure at a high side of the system to a pressure of a low side of the system). In an over-compression condition, the compression mechanism is compressing fluid to a pressure higher than the pressure of fluid downstream of a discharge fitting of the compressor. Accordingly, in an over-compression condition, the compressor is performing unnecessary work, which reduces the efficiency of the compressor. The compressor 10 of the present disclosure may reduce or prevent over-compression by allowing fluid to exit the compression mechanism 20 through the first apertures 94 and the secondary discharge valve assemblies 104 before the fluid pocket reaches the discharge passage 90.

The valve members 152 of the secondary discharge valve assemblies 104 move between the open and closed positions in response to pressure differentials between fluid in the intermediate fluid pockets 91 at radially intermediate positions and fluid in the discharge chamber 40. When fluid in fluid pockets 91 at radially intermediate positions is at a pressure that is greater than the pressure of the fluid in the discharge chamber 40, the relatively high-pressure fluid in the fluid pockets 91 may flow into the first apertures 94 and may force the valve members 152 upward toward the open position (i.e., whereby the movable ends 162 of the valve members 152 are spaced apart from the end plate 86) to allow fluid to be discharged from the compression mechanism 20 through the first apertures 94 and into the discharge chamber 40 via the recess 128 and aperture 129 of the hub plate 98 (i.e., around the outside of the retainer 130 of the primary discharge valve assembly 102). In this manner, the first apertures 94 may function as secondary discharge passages that may reduce or prevent over-compression of the working fluid.

When the pressure of the fluid in the fluid pockets 91 at the intermediate position corresponding to the first apertures 94 falls below the pressure of the fluid in the discharge chamber 40, the movable ends 162 of the valve members 152 may resiliently return to the closed position (FIG. 2), where the valve members 152 are sealingly engaged with the end plate 86 to restrict or prevent fluid-flow through the first apertures 94.

Figure 6:
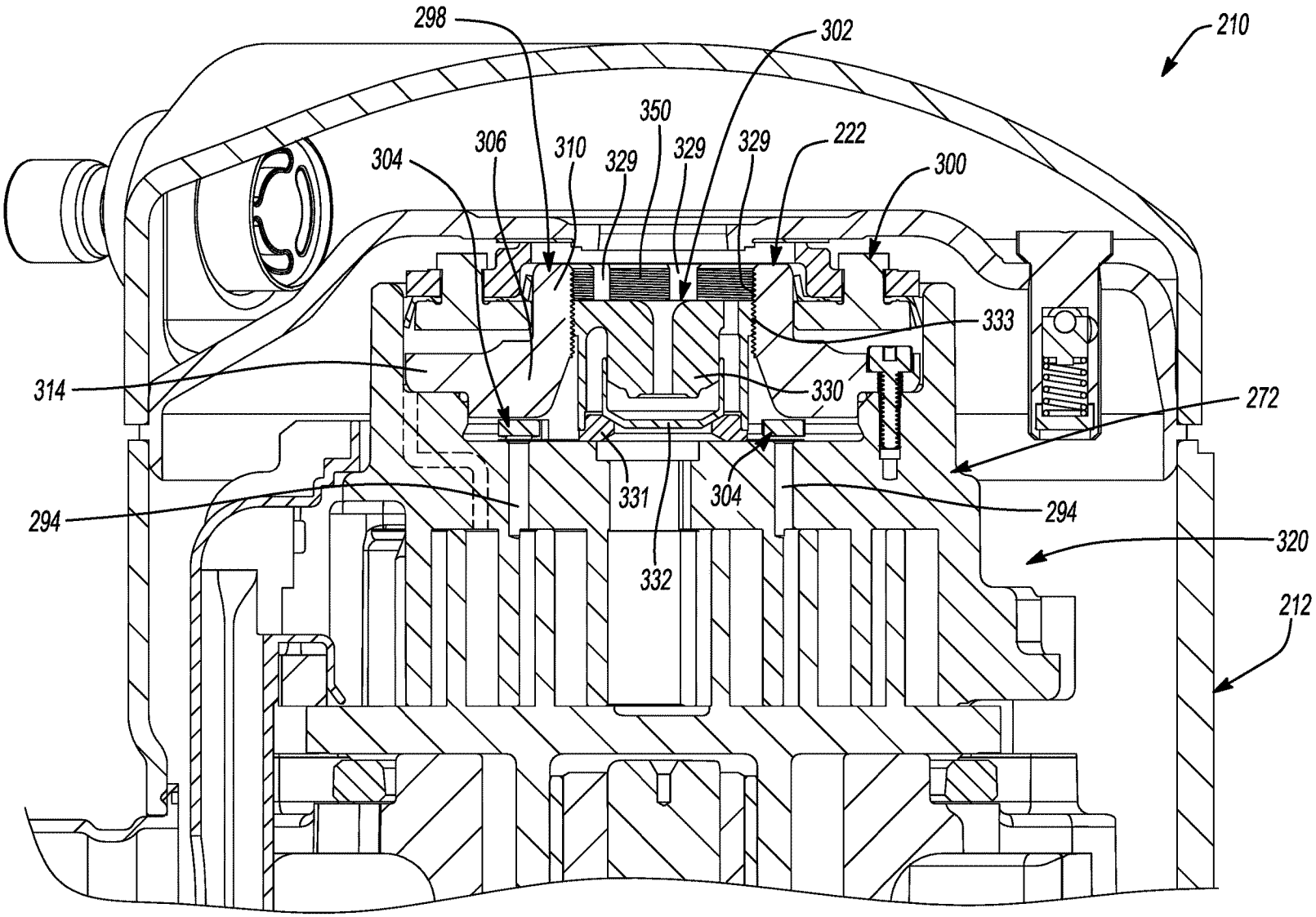
FIG. 6 is a cross-sectional view of a portion of another compressor according to the principles of the present disclosure.
Figure 7:
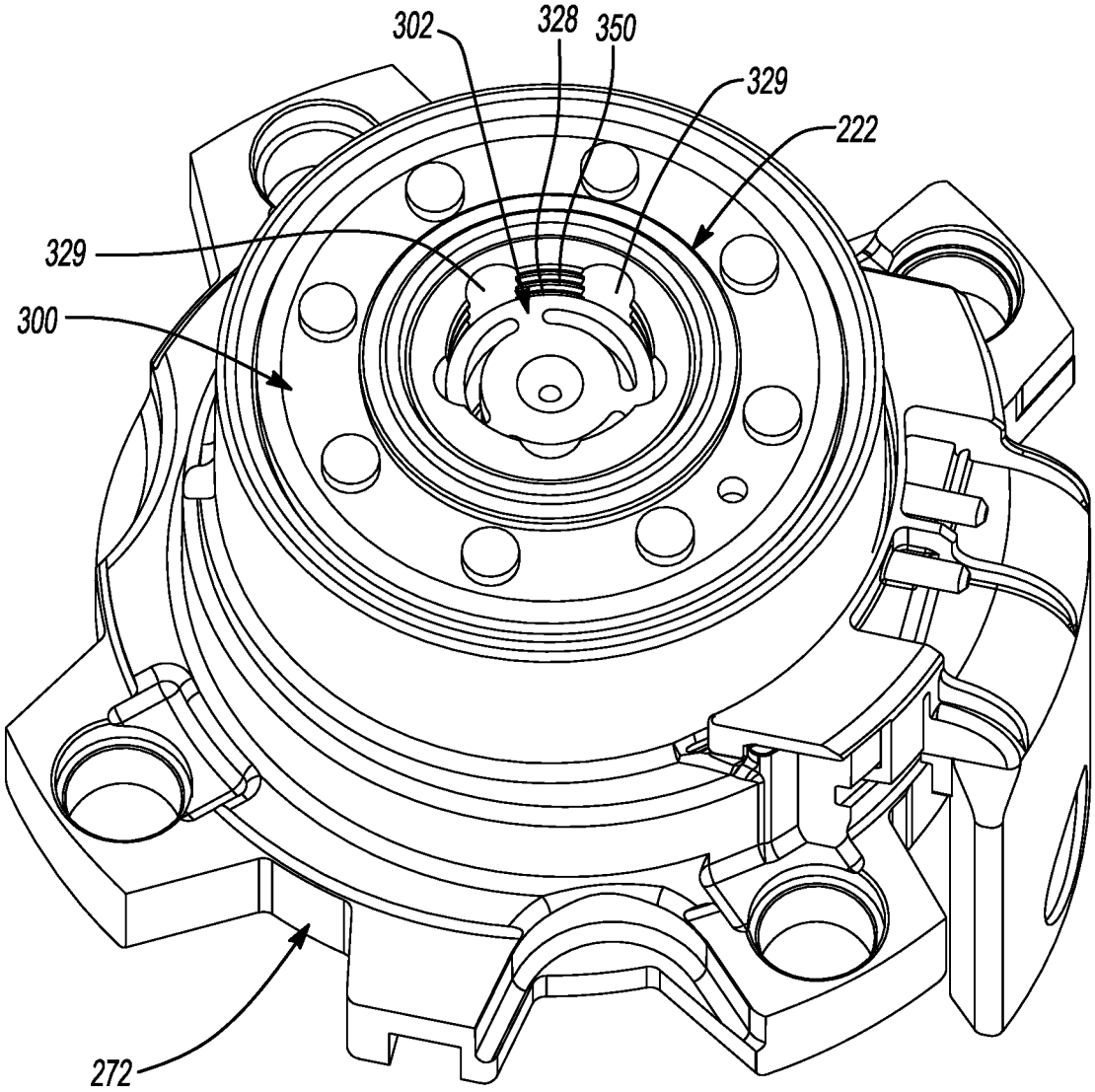
FIG. 7 is a perspective view of a non-orbiting scroll and hub assembly of the compressor of FIG. 6.

With reference to FIGS. 6 and 7, another compressor 210 is provided. The structure and function of the compressor 210 may be similar or identical to that of the compressor 10 described above, apart from any differences described below and/or shown in the figures. Therefore, similar features may not be described again in detail. Like the compressor 10, the compressor 210 may include a shell assembly 212 (similar or identical to the shell assembly 12), a first and second bearing-housing assemblies (similar or identical to the bearing-housing assemblies 14, 16), a motor assembly (similar or identical to the motor assembly 18), a compression mechanism 220 (similar or identical to the compression mechanism 20), and a hub assembly 222 (similar to the hub assembly 22).

The hub assembly 222 may include a hub plate 298, a seal assembly 300, a primary discharge valve assembly 302, and one or more secondary discharge valve assemblies 304. The structures and functions of the seal assembly 300 and the secondary discharge valve assemblies 304 may be substantially identical to that of the seal assembly 100 and the secondary discharge valve assemblies 104, respectively.

The structure and function of the hub plate 298 may be similar to that of the hub plate 98 described above, except the primary discharge valve assembly 302 may be threadably engaged with the hub plate 298. Like the hub plate 98, the hub plate 298 may include a main body 306, a central hub 310, and a mounting flange 314. The structure and function of the main body 306 and mounting flange 314 may be substantially similar to that of the main body 106 and mounting flange 114. The central hub 310 includes a recess 328 and one or more scallop-shaped apertures 329. The recess 328 may include internal threads 350. As in the primary discharge valve 102, the recess 328 and apertures 329 are in fluid communication with first apertures 294 in the non-orbiting scroll 272 when the secondary discharge valve assemblies 304 are in the open position.

The primary discharge valve assembly 302 may include a retainer (or valve body) 330 and a valve member 332 that is movable relative to the retainer 330. In some configurations, the primary discharge valve assembly 302 may also include an annular valve seat 331. The structure and function of the retainer 330, valve member 332, and valve seat 331 may be similar or identical to that of the retainer 130, valve member 132, and valve seat 131, except the retainer 330 includes external threads 333 that threadably engage the threads 350 of the hub plate 298. This threaded engagement is what fixedly secures the retainer 330 to the hub plate 298 (unlike the retainer 130 that is secured to the hub plate 98 by being biased against the ledge 149 by spring 133).

Operation of the compressor 210 may be similar or identical to operation of the compressor 10, and therefore, will not be described again.

Figure 8:
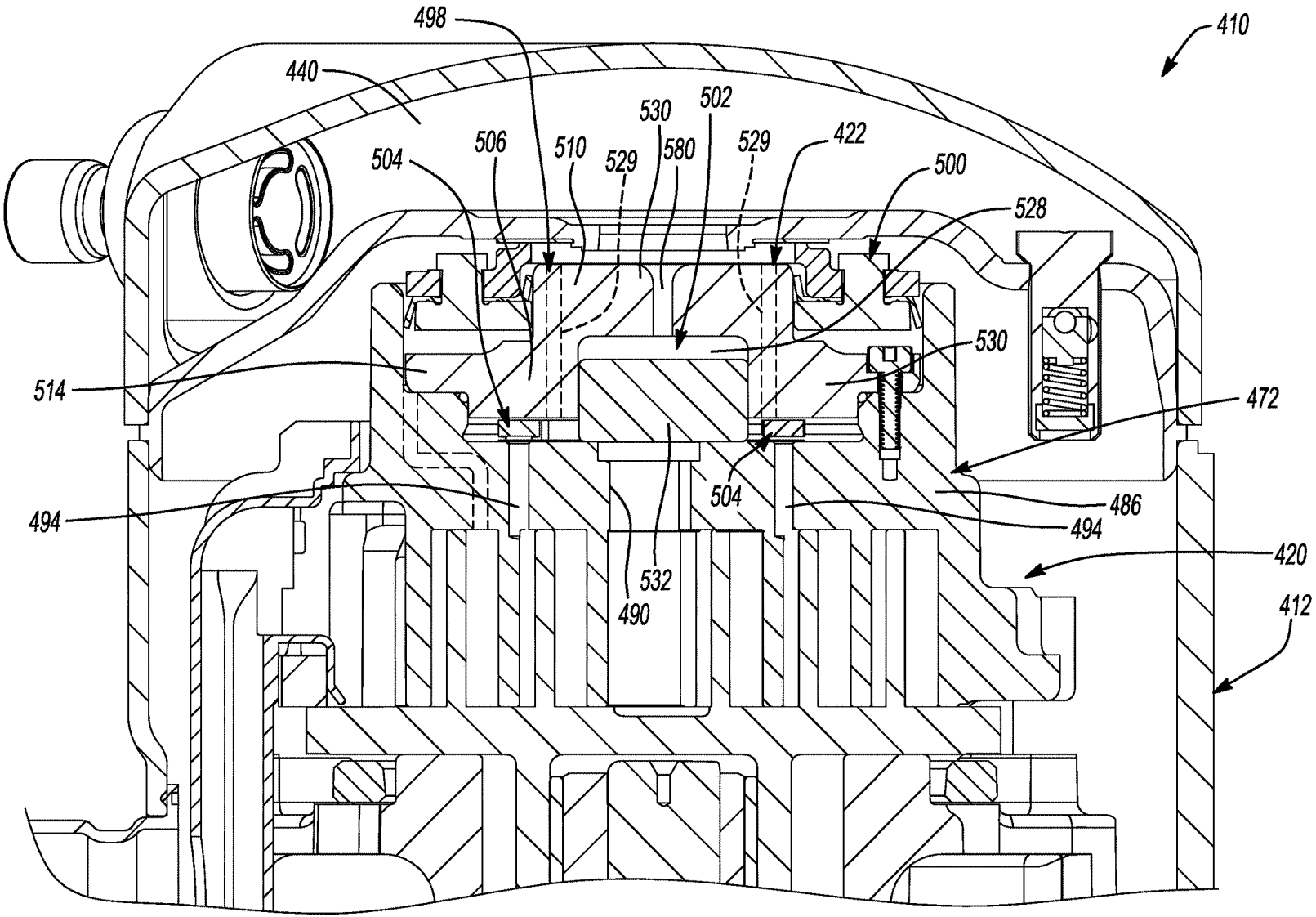
FIG. 8 is a cross-sectional view of a portion of yet another compressor according to the principles of the present disclosure.
Figure 9:
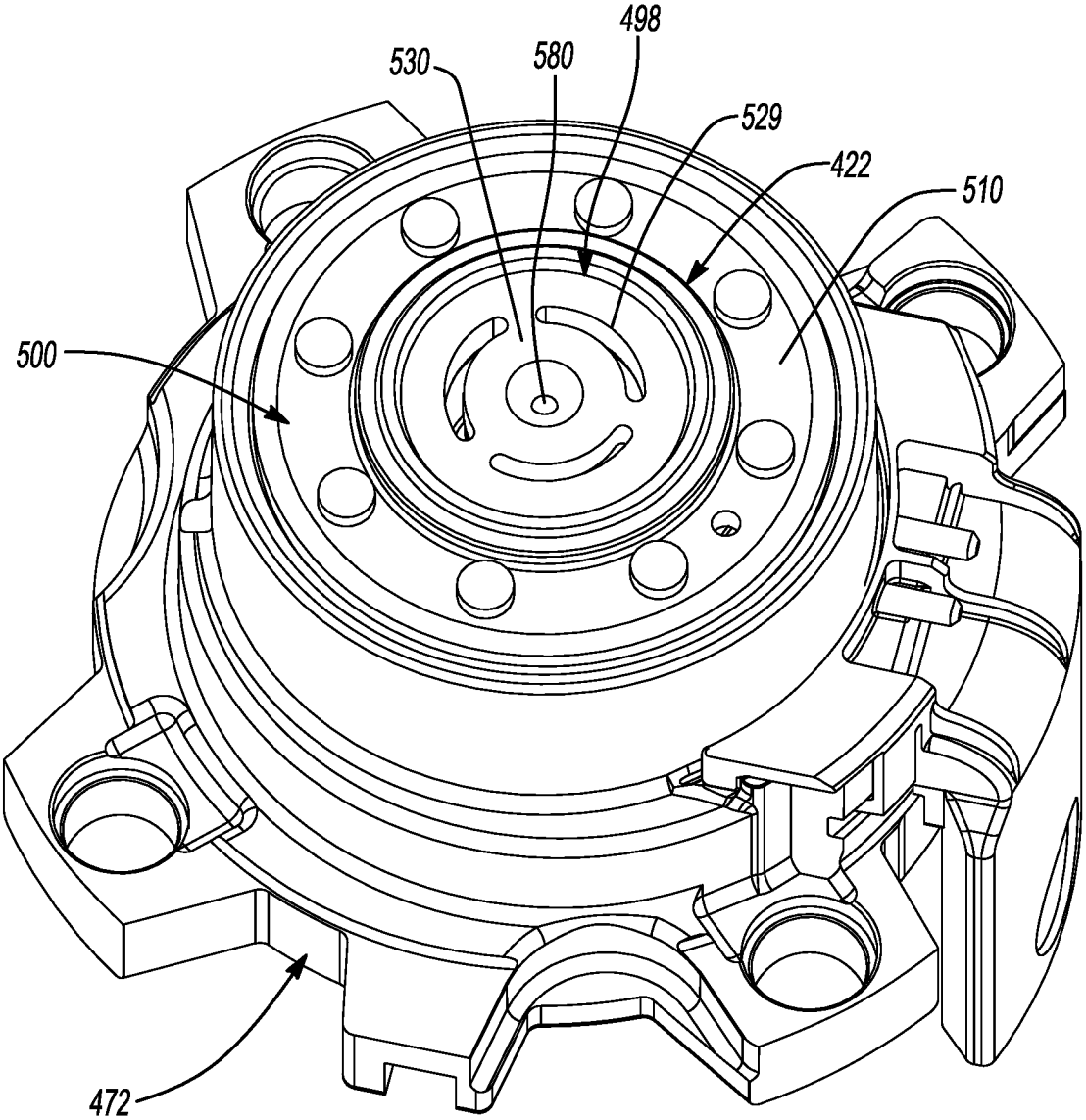
FIG. 9 is a perspective view of a non-orbiting scroll and hub assembly of the compressor of FIG. 8.

With reference to FIGS. 8 and 9, another compressor 410 is provided. The structure and function of the compressor 410 may be similar or identical to that of the compressor 10, 210 described above, apart from any differences described below and/or shown in the figures. Therefore, similar features may not be described again in detail. Like the compressor 10, the compressor 410 may include a shell assembly 412 (similar or identical to the shell assembly 12), first and second bearing-housing assemblies (similar or identical to the bearing-housing assemblies 14, 16), a motor assembly (similar or identical to the motor assembly 18), a compression mechanism 420 (similar or identical to the compression mechanism 20), and a hub assembly 422 (similar to the hub assembly 22). Operation of the compressor 410 may be similar or identical to operation of the compressor 10.

The hub assembly 422 may include a hub plate 498, a seal assembly 500, a primary discharge valve assembly 502, and one or more secondary discharge valve assemblies 504. The structures and functions of the seal assembly 500 and the secondary discharge valve assemblies 504 may be substantially identical to that of the seal assembly 100 and the secondary discharge valve assemblies 104, respectively.

Like the hub plate 98, the hub plate 498 may include a main body 506, a central hub 510, and a mounting flange 514. The structure and function of the main body 506 and mounting flange 514 may be substantially similar to that of the main body 106 and mounting flange 114. The central hub 510 includes an integrally formed valve retainer (or valve body) 530 and a recess 528. The retainer 530 may include a plurality of apertures 529 that are in fluid communication with discharge chamber 440 (similar or identical to discharge chamber 40). The apertures 529 are in fluid communication with first apertures 494 in the non-orbiting scroll 472 when the secondary discharge valve assemblies 504 are in the open position.

The primary discharge valve assembly 502 may include the retainer 530 and a valve member 532 that is movable relative to the retainer 530. The valve member 532 can be a cylindrical block, for example. The function of the retainer 530 and valve member 532 may be similar or identical to that of the retainer 130 and valve member 132. During operation of the compressor 410, fluid pressure in the discharge passage 490 forces the valve member 532 upward to an open position (i.e., spaced apart from the end plate 486 of the non-orbiting scroll 472) to allow the fluid to flow from the discharge passage 490 and through apertures 529 and into the discharge chamber 440. The retainer 530 may include a central aperture 580 (similar to central aperture 180) through which fluid from the discharge chamber 440 may flow to force the valve member 532 down into contact with the end plate 486 when the compressor 410 shuts down. In this manner, the valve member 532 prevents back-flow of working fluid from the discharge chamber 440 into the compression mechanism 420.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell assembly;

a non-orbiting scroll disposed within the shell assembly and including a first end plate and a first spiral wrap, the first end plate including a primary discharge passage and a secondary discharge passage located radially outward relative to the primary discharge passage;

an orbiting scroll disposed within the shell assembly and including a second end plate having a second spiral wrap extending therefrom and meshingly engaged with the first spiral wrap;

a hub plate mounted to the non-orbiting scroll and including a main body and a central hub extending axially from the main body, wherein the central hub includes a recess and a hub aperture, and wherein the hub aperture is in selective fluid communication with the primary and secondary discharge passages;

a primary discharge valve assembly including a retainer and a primary valve member, wherein the retainer is disposed at least partially within the recess of the hub plate, wherein the retainer includes a retainer aperture in fluid communication with the hub aperture, wherein the primary valve member is slidably engaged with the retainer, wherein when the primary valve member is in a closed position, the primary valve member restricts fluid flow between a discharge chamber and the primary discharge passage, and wherein a first axial end of the retainer contacts an annular ledge, and wherein the hub aperture is disposed radially outward relative to the annular ledge; and a secondary discharge valve assembly including a secondary valve member disposed between the hub plate and the first end plate, wherein the secondary valve member is movable relative to the hub plate and the first end plate, wherein when the secondary valve member is in an open position, fluid is allowed to flow from the secondary discharge passage around an outer periphery of the retainer of the primary discharge valve assembly and through the hub aperture, and wherein when the secondary valve member is in a closed position, the secondary valve member restricts fluid communication between the secondary discharge passage and the hub aperture of the central hub.

2. The compressor of claim 1, wherein the first end plate of the non-orbiting scroll includes an annular rim that surrounds an outer periphery of the hub plate and defines a recess in which the hub plate is received.

3. The compressor of claim 2, further comprising a floating seal assembly at least partially received in the recess defined by the annular rim.

4. The compressor of claim 3, wherein the floating seal assembly, the annular rim, and the hub plate cooperate to define a biasing chamber that receives intermediate-pressure working fluid from an aperture in the first end plate.

5. The compressor of claim 4, wherein the primary valve member is a cup-shaped member that slidably engages an inner hub of the retainer.

6. The compressor of claim 5, wherein the inner hub of the retainer includes a central aperture, and wherein the retainer aperture and the hub aperture are disposed radially outward relative to the central aperture.

7. The compressor of claim 1, wherein the primary discharge valve assembly includes a spring disposed between the first end plate and a second axial end of the retainer, and wherein the spring biases the retainer into contact with the annular ledge.

8. The compressor of claim 1, wherein the secondary valve member is a reed valve including a fixed end and a movable end that is resiliently bendable relative to the fixed end.

9. The compressor of claim 1, further comprising:

a drive bearing formed from a polymeric material; and a main bearing formed from aluminum, wherein the drive bearing engages a cylindrical hub of the orbiting scroll and surrounds a crank pin of a crankshaft that drives the orbiting scroll, and wherein the main bearing rotatably support a main body of the crankshaft.

10. The compressor of claim 1, wherein the non-orbiting scroll includes at least another secondary discharge passage located radially outward relative to the primary discharge passage, and wherein the hub aperture has a larger area than a sum of areas of the secondary discharge passages.

11. A compressor comprising:

a shell assembly;

a non-orbiting scroll disposed within the shell assembly and including a first end plate and a first spiral wrap, the first end plate including a primary discharge passage and a secondary discharge passage located radially outward relative to the primary discharge passage;

an orbiting scroll disposed within the shell assembly and including a second end plate having a second spiral wrap extending therefrom and meshingly engaged with the first spiral wrap;

a hub plate mounted to the non-orbiting scroll and including a main body and a central hub extending axially from the main body, wherein the central hub includes a recess and a hub aperture, and wherein the hub aperture is in selective fluid communication with the primary and secondary discharge passages;

a primary discharge valve assembly including a retainer and a primary valve member, wherein the retainer is disposed at least partially within the recess of the hub plate, wherein the retainer includes a retainer aperture in fluid communication with the hub aperture, wherein the primary valve member is slidably engaged with the retainer, and wherein when the primary valve member is in a closed position, the primary valve member restricts fluid flow between a discharge chamber and the primary discharge passage; and a secondary discharge valve assembly including a secondary valve member disposed between the hub plate and the first end plate, wherein the secondary valve member is movable relative to the hub plate and the first end plate, wherein when the secondary valve member is in an open position, fluid is allowed to flow from the secondary discharge passage around an outer periphery of the retainer of the primary discharge valve assembly and through the hub aperture, and wherein when the secondary valve member is in a closed position, the secondary valve member restricts fluid communication between the secondary discharge passage and the hub aperture of the central hub, wherein the retainer includes external threads that threadably engages internal threads formed on the central hub of the hub plate, and wherein the hub aperture is disposed radially outward relative to the internal threads of the hub plate.

12. The compressor of claim 11, wherein the first end plate of the non-orbiting scroll includes an annular rim that surrounds an outer periphery of the hub plate and defines a recess in which the hub plate is received.

13. The compressor of claim 12, further comprising a floating seal assembly at least partially received in the recess defined by the annular rim.

14. The compressor of claim 13, wherein the floating seal assembly, the annular rim, and the hub plate cooperate to define a biasing chamber that receives intermediate-pressure working fluid from an aperture in the first end plate.

15. The compressor of claim 14, wherein the primary valve member is a cup-shaped member that slidably engages an inner hub of the retainer.

16. The compressor of claim 15, wherein the inner hub of the retainer includes a central aperture, and wherein the retainer aperture and the hub aperture are disposed radially outward relative to the central aperture.

17. The compressor of claim 11, wherein the secondary valve member is a reed valve including a fixed end and a movable end that is resiliently bendable relative to the fixed end.

18. The compressor of claim 11, further comprising:

a drive bearing formed from a polymeric material; and a main bearing formed from aluminum, wherein the drive bearing engages a cylindrical hub of the orbiting scroll and surrounds a crank pin of a crankshaft that drives the orbiting scroll, and wherein the main bearing rotatably support a main body of the crankshaft.

* * * * *